US009037383B2

(12) United States Patent
Okazaki

(10) Patent No.: US 9,037,383 B2
(45) Date of Patent: May 19, 2015

(54) FUEL INJECTION AMOUNT CONTROL APPARATUS FOR INTERNAL COMBUSTION ENGINE

(75) Inventor: Shuntaro Okazaki, Shizuoka-ken (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 778 days.

(21) Appl. No.: 13/210,997

(22) Filed: Aug. 16, 2011

(65) Prior Publication Data

US 2012/0065870 A1 Mar. 15, 2012

(30) Foreign Application Priority Data

Sep. 10, 2010 (JP) ..... 2010-203064

(51) Int. Cl.
*F01N 11/00* (2006.01)
*F02D 41/14* (2006.01)
*F02D 41/24* (2006.01)

(52) U.S. Cl.
CPC ..... *F02D 41/1483* (2013.01); *F02D 41/1441* (2013.01); *F02D 41/1482* (2013.01); *F02D 41/2454* (2013.01); *F02D 2041/1422* (2013.01)

(58) Field of Classification Search
CPC ..... F02D 41/1458; F02D 41/1404; F02D 41/1402; F02D 41/1456; F02D 41/1441; F02D 41/1403; F02D 2041/1418; F02D 2041/1433; F01N 13/009; F01N 11/00; F01N 11/002; F01N 11/007
USPC ..... 701/109, 103, 104; 123/674, 672, 693, 123/694, 695, 696, 692; 60/285, 276
See application file for complete search history.

(56) References Cited

U.S. PATENT DOCUMENTS

| | | | | |
|---|---|---|---|---|
| 6,112,517 | A * | 9/2000 | Yasui et al. | 60/274 |
| 6,311,481 | B1 * | 11/2001 | Wada | 60/277 |
| 6,314,723 | B1 * | 11/2001 | Ketterer et al. | 60/277 |
| 6,351,943 | B1 * | 3/2002 | Tagami et al. | 60/285 |
| 6,383,267 | B1 * | 5/2002 | Takaku et al. | 96/111 |
| 6,453,229 | B1 * | 9/2002 | Ohkuma et al. | 701/109 |
| 6,901,744 | B2 * | 6/2005 | Kako et al. | 60/285 |

(Continued)

FOREIGN PATENT DOCUMENTS

| | | |
|---|---|---|
| JP | 5-133264 A | 5/1993 |
| JP | 11072473 A | 3/1999 |

(Continued)

*Primary Examiner* — Stephen K Cronin
*Assistant Examiner* — Gonzalo Laguarda
(74) *Attorney, Agent, or Firm* — Gifford, Krass, Sprinkle, Anderson & Citkowski, P.C.

(57) ABSTRACT

A fuel injection amount control apparatus calculates as a proportional term a value obtained by multiplying by a proportional gain Kp a deviation DVoxslow between a downstream side target value Voxsref and an output value Voxs of a downstream side air-fuel ratio sensor disposed downstream of a catalyst. The control apparatus calculates a time integrated value SDVoxslow by integrating a value obtained by multiplying by a predetermined adjustment gain K the deviation DVoxslow, calculates a value that is commensurate with the time integrated value SDVoxslow as an integral term Ki×SDVoxslow, and obtains the integral term Ki×SDVoxslow as a sub-FB learned value KSFBg. The control apparatus sets the proportional gain Kp at a small value after the sub-FB learned value KSFBg is determined to have converged, and sets the adjustment gain K at a small value after the sub-FB learned value KSFBg is determined to have converged.

3 Claims, 19 Drawing Sheets

(56) References Cited

U.S. PATENT DOCUMENTS

| | | | | |
|---|---|---|---|---|
| 7,386,388 | B2 * | 6/2008 | Akazaki et al. | 701/103 |
| 2005/0072410 | A1 * | 4/2005 | Ohsaki | 123/674 |
| 2010/0168986 | A1 * | 7/2010 | Iwazaki et al. | 701/103 |
| 2010/0211290 | A1 * | 8/2010 | Kidokoro et al. | 701/103 |
| 2011/0191005 | A1 * | 8/2011 | Iwazaki et al. | 701/101 |
| 2011/0282541 | A1 | 11/2011 | Kidokoro et al. | |
| 2012/0173116 | A1 * | 7/2012 | Iwazaki et al. | 701/101 |

FOREIGN PATENT DOCUMENTS

| | | | |
|---|---|---|---|
| JP | 2000065782 | A | 3/2000 |
| JP | 2002-250248 | A | 9/2002 |
| JP | 2004069547 | A | 3/2004 |
| JP | 2007-321620 | A | 12/2007 |
| JP | 2009-030455 | A | 2/2009 |
| JP | 2009-162139 | A | 7/2009 |
| WO | 2010087026 | A1 | 8/2010 |

* cited by examiner $$KF = \frac{Fbaset(k-N)}{Fbaseb(k-N)} = \frac{(abyfs(k) \cdot Fi(k-N))/abyfr(k-N)}{Fbaseb(k-N)}$$

Fbaset : TRUE INJECTION AMOUNT REQUIRED TO OBTAIN TARGET AIR-FUEL RATIO

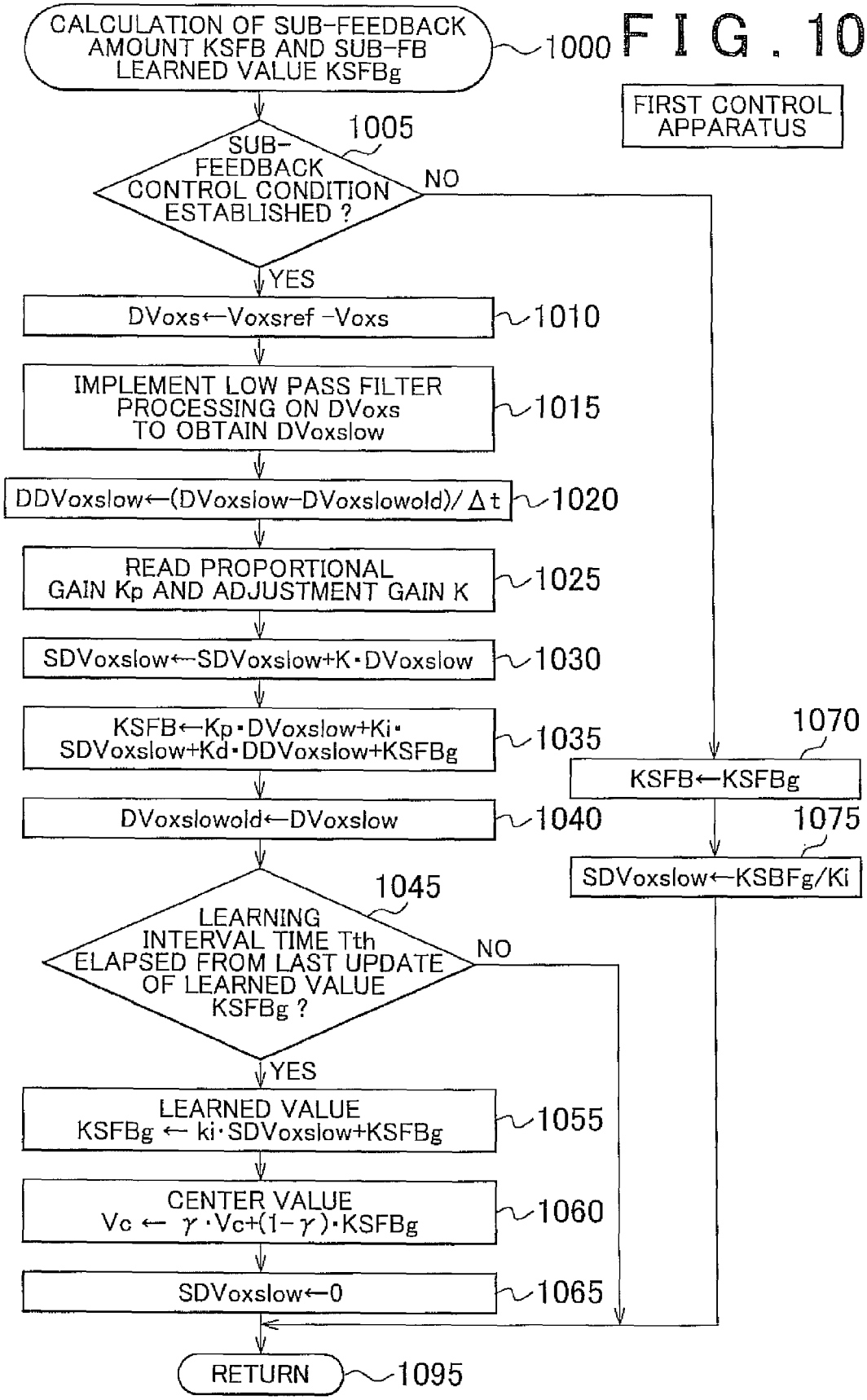
FIG. 10
CALCULATION OF SUB-FEEDBACK AMOUNT KSFB AND SUB-FB LEARNED VALUE KSFBg
1000
FIRST CONTROL APPARATUS
SUB-FEEDBACK CONTROL CONDITION ESTABLISHED ?
1005
NO
YES
DVoxs←Voxsref −Voxs
1010
IMPLEMENT LOW PASS FILTER PROCESSING ON DVoxs TO OBTAIN DVoxslow
1015
DDVoxslow←(DVoxslow−DVoxslowold)/Δt
1020
READ PROPORTIONAL GAIN Kp AND ADJUSTMENT GAIN K
1025
SDVoxslow←SDVoxslow+K·DVoxslow
1030
KSFB←Kp·DVoxslow+Ki·SDVoxslow+Kd·DDVoxslow+KSFBg
1035
DVoxslowold←DVoxslow
1040
1070
KSFB←KSFBg
1075
SDVoxslow←KSBFg/Ki
LEARNING INTERVAL TIME Tth ELAPSED FROM LAST UPDATE OF LEARNED VALUE KSFBg ?
1045
NO
YES
LEARNED VALUE KSFBg ← ki·SDVoxslow+KSFBg
1055
CENTER VALUE Vc ← γ·Vc+(1−γ)·KSFBg
1060
SDVoxslow←0
1065
RETURN
1095

FUEL INJECTION AMOUNT CONTROL APPARATUS FOR INTERNAL COMBUSTION ENGINE

CROSS-REFERENCE TO RELATED APPLICATIONS

This application claims priority to Japanese Patent Application No. 2010-203064, filed on Sep. 10, 2010, which is incorporated herein by reference in its entirety including the specification, drawings and abstract.

BACKGROUND OF THE INVENTION

1. Field of the Invention

The invention relates to a fuel injection amount control apparatus for an internal combustion engine, which controls a fuel injection amount on the basis of an output value of an air-fuel ratio sensor (a downstream side air-fuel ratio sensor) disposed downstream of a catalyst that is provided in an exhaust passage of the internal combustion engine.

2. Description of Related Art

As shown in FIG. 1, a typical fuel injection amount control apparatus for an internal combustion engine includes a catalyst (a three-way catalyst) 43 disposed in an exhaust passage of the engine, an upstream side air-fuel ratio sensor 56, and a downstream side air-fuel ratio sensor 57. The upstream side air-fuel ratio sensor 56 and the downstream side air-fuel ratio sensor 57 are disposed upstream and downstream of the catalyst 43, respectively.

An output value Vabyfs of the upstream side air-fuel ratio sensor 56 varies relative to an air-fuel ratio (an upstream side air-fuel ratio abyfs) of a detected gas in a manner shown in FIG. 2.

An output value Voxs of the downstream side air-fuel ratio sensor 57 varies relative to an air-fuel ratio (a downstream side air-fuel ratio afdown) of the detected gas in the manner shown in FIG. 3. More specifically, the output value Voxs takes a maximum output value max when the air-fuel ratio of the detected gas is richer than a stoichiometric air-fuel ratio and takes a minimum output value min when the air-fuel ratio of the detected gas is leaner than the stoichiometric air-fuel ratio. The output value Voxs varies rapidly from the minimum output value min to the maximum output value max when the air-fuel ratio of the detected gas varies from a leaner air-fuel ratio than the stoichiometric air-fuel ratio to a richer air-fuel ratio than the stoichiometric air-fuel ratio, and varies rapidly from the maximum output value max to the minimum output value min when the air-fuel ratio of the detected gas varies from a richer air-fuel ratio than the stoichiometric air-fuel ratio to a leaner air-fuel ratio than the stoichiometric air-fuel ratio.

The fuel injection amount control apparatus calculates a "correction amount of the fuel injection amount" for aligning the air-fuel ratio (the upstream side air-fuel ratio abyfs) expressed by the output value of the upstream side air-fuel ratio sensor with a "target air-fuel ratio set at the stoichiometric air-fuel ratio". The correction amount will also be referred to as a main feedback amount. Air-fuel ratio feedback control using the main feedback amount will be referred to as main feedback control.

Further, the fuel injection amount control apparatus calculates a "correction amount of the fuel injection amount" separately from the main feedback amount" on the basis of a "difference (also referred to as an "output deviation" hereafter) between the output value of the downstream side air-fuel ratio sensor and a downstream side target value set at a value substantially corresponding to the stoichiometric air-fuel ratio". This correction amount will also be referred to as a sub-feedback amount. Air-fuel ratio feedback control using the sub-feedback amount will be referred to as sub-feedback control. The fuel injection amount control apparatus then corrects the fuel injection amount using the main feedback amount and the sub-feedback amount, whereby the air-fuel ratio of an air-fuel mixture supplied to the engine is controlled to the stoichiometric air-fuel ratio. Note that the air-fuel ratio of the air-fuel mixture supplied to the engine will also be referred to as the air-fuel ratio of the engine, and is substantially equal to the air-fuel ratio of exhaust gas flowing into the catalyst 43.

The sub-feedback amount is calculated through PI control or PID control, and therefore includes at least a proportional term and an integral term. More specifically, the fuel injection amount control apparatus calculates the proportional term of the sub-feedback amount by multiplying a proportional gain by the output deviation. The fuel injection amount control apparatus calculates a time integrated value by integrating a value obtained by multiplying an adjustment gain by the output deviation, and calculates the integral term of the sub-feedback amount on the basis of the time integrated value.

Incidentally, a steady state error occurs in the target air-fuel ratio of the air-fuel ratio of the engine due to an intake air amount detection error by an air flow meter, individual differences or temporal deterioration in an injection characteristic of a fuel injection valve, an air-fuel ratio detection error by the upstream side air-fuel ratio sensor, and so on (to be referred to collectively hereafter as an "intake/exhaust system error"). Accordingly, the intake/exhaust system error appears in the time integrated value. In other words, the time integrated value converges on an identical value to a value expressing the magnitude of the intake/exhaust system error. Therefore, the fuel injection amount control apparatus is able substantially to align the air-fuel ratio of the engine with the stoichiometric air-fuel ratio even when an error occurs in the intake/exhaust system.

However, a predetermined amount of time is required for the time integrated value to converge. Moreover, during a "period in which a sub-feedback control condition (downstream side feedback condition) is not established" such as when the downstream side air-fuel ratio sensor is not active, for example, the time integrated value is not updated. Hence, the fuel injection amount control apparatus obtains the time integrated value (or the "integral term of the sub-feedback amount", which is a value that correlates with the time integrated value) as a learned value (a sub-feedback (FB) learned value) of the sub-feedback amount at intervals of a predetermined learning interval time Tth.

The learning interval time Tth is longer than an update interval time of the sub-feedback amount (and therefore the time integrated value). The sub-FB learned value is stored in a "backup random access memory (RAM) or the like capable of holding data even when the engine is inoperative". Further, the fuel injection amount control apparatus controls the fuel injection amount using the sub-FB learned value during the period in which the sub-feedback control condition is not established, and when the sub-feedback control condition is established, the fuel injection amount control apparatus uses a value corresponding to the sub-FB learned value as an initial value of the time integrated value. Hence, during the period in which the sub-feedback control condition is not established, the fuel injection amount can be controlled to an optimum value. Furthermore, the time integrated value can be set at an appropriate value immediately after the sub-feedback control condition is established.

The sub-FB learned value may diverge greatly from an intended convergence value. The intended convergence value of the sub-FB learned value is a value expressing the magnitude of the error in the intake/exhaust system, and will be referred to as a "convergence value" hereafter. For example, the sub-FB learned value may diverge greatly from the convergence value when the sub-FB learned value stored in the backup RAM is cleared due to battery replacement or the like. The sub-FB learned value may also diverge greatly from the convergence value when a misfire rate of the engine varies, when the fuel injection characteristic of the fuel injection valve in a specific cylinder differs greatly from the fuel injection characteristic of the fuel injection valves in another cylinder, and so on. FIG. 4A shows an outline of the manner in which the sub-FB learned value gradually converges from a state of diverging greatly from the convergence value.

The fuel injection amount control apparatus modifies a "variation speed of the time integrated value" in accordance with a degree of convergence of the sub-FB learned value so that the sub-FB learned value converges with the convergence value quickly. More specifically, when a variation amount (an amount of change) of the sub-FB learned value within a predetermined period exceeds a predetermined width, the fuel injection amount control apparatus determines that the sub-FB learned value has not converged, and therefore increases an amount by which the time integrated value is updated per update. When the variation amount of the sub-FB learned value within the predetermined period does not exceed the predetermined width, on the other hand, the fuel injection amount control apparatus determines that the sub-FB learned value has converged, and therefore reduces the amount by which the time integrated value is updated per update. As a result, the sub-FB learned value can be brought close to the convergence value quickly when the sub-FB learned value has not converged, and excessive variation in the sub-FB learned value due to disturbances can be avoided when the sub-FB learned value has converged (see Japanese Patent Application Publication No. 2009-162139 (JP-A-2009-162139), for example). by modifying the update amount of the time integrated value per update in this manner, it is important to determine whether or not the learned value has converged with a high degree of precision in order to set the "update amount of the time integrated value per update" at an appropriate value. Even with an apparatus that does not modify the update amount of the time integrated value per update, it is important to determine whether or not the sub-FB learned value has converged with a high degree of precision in an "apparatus that obtains a degree of unevenness among air-fuel ratios of respective cylinders on the basis of a value that correlates with the sub-FB learned value" or the like (see Japanese Patent Application Publication No. 2009-30455 (JP-A-2009-30455), for example).

As shown in FIG. 4B, a variation amount of the sub-FB learned value varies substantially depending on the magnitude of "the proportional term of the sub-feedback amount" in a situation where the sub-FB learned value is substantially converged.

More specifically, in FIG. 4B, a "proportional gain for calculating the proportional term of the sub-feedback amount" within a period extending from a time t0 to a time t4 is set at substantially double the proportional gain from the time t4 onward. The proportional term of the sub-feedback amount is a "product of the output deviation and the proportional gain". In accordance with the characteristics of the downstream side air-fuel ratio sensor 57, the output value Voxs of the downstream side air-fuel ratio sensor 57 substantially takes either "the maximum output value max or the minimum output value min", and the downstream side target value is substantially unchanging. Therefore, the magnitude of the output deviation is substantially constant. Hence, the magnitude of the proportional term of the sub-feedback amount within the period from the time t0 to the time t4 is substantially double the magnitude of the proportional term from the time t4 onward. Meanwhile, the integral term of the sub-feedback amount is substantially converged, and therefore the air-fuel ratio of the gas flowing into the catalyst 43 varies substantially on the basis of the proportional term of the sub-feedback amount.

Hence, a "reduction speed of an oxygen storage amount OSA of the catalyst 43" from the time t0 to a time t1 and from a time t2 to a time t3 is double the reduction speed of the oxygen storage amount OSA from the time t4 to a time t5 and from a time t6 to a time t7. Similarly, an "increase speed of the oxygen storage amount OSA of the catalyst 43" from the time t1 to the time t2 and from the time t3 to the time t4 is double the increase speed of the oxygen storage amount OSA from the time t5 to the time t6 and from the time t7 to a time t8.

Meanwhile, the output value Voxs of the downstream side air-fuel ratio sensor 57 varies from the minimum output value min to the maximum output value max when the oxygen storage amount OSA of the catalyst 43 reaches "0" such that rich gas flows out from the catalyst 43, and varies from the maximum output value max to the minimum output value min when the oxygen storage amount OSA of the catalyst 43 reaches a maximum oxygen storage amount Cmax (a maximum value of the amount of oxygen that can be stored by the catalyst 43) such that lean gas flows out from the catalyst 43.

As a result, an inversion period (a time required to vary to the minimum output value min after varying from the minimum output value min to the maximum output value max and then to vary back to the maximum output value max) of the output value Voxs of the downstream side air-fuel ratio sensor 57 is substantially inversely proportionate to the proportional gain. In other words, the inversion period during the period from the time t0 to the time t4 is ½ the inversion period during the period from the time t4 to the time t8.

The time integrated value and the integral term of the sub-feedback amount, meanwhile, vary substantially in proportion with a length of the inversion period, and therefore the sub-FB learned value also varies substantially in proportion with the length of the inversion period. Hence, a variation amount (variation width) D1 of the sub-FB learned value during the period from the time t4 to the time t8 is double a variation amount D2 of the sub-FB learned value during the period from the time t0 to the time t4.

As is evident from the above description, by setting the proportional gain to take a large value when the sub-FB learned value is in a substantially converged condition, the variation amount of the sub-FB learned value can be reduced. In other words, setting the proportional gain at a large value is useful for determining early that the sub-FB learned value has converged.

However, NOx and unburned material are discharged from the catalyst 43 every time the oxygen storage amount OSA of the catalyst 43 reaches the "maximum oxygen storage amount Cmax" and "0", respectively. Therefore, when the proportional gain remains set at a large value even after the sub-FB learned value is determined to have converged, the frequency with which NOx and unburned material are discharged increases, which is undesirable in terms of reducing emissions.

SUMMARY OF THE INVENTION

The invention provides a "fuel injection amount control apparatus for an internal combustion engine" that is capable of determining whether or not a learned value (a sub-FB learned value) has converged quickly and precisely and reducing emissions after determining that the learned value has converged.

A fuel injection amount control apparatus for an internal combustion engine according to an aspect of the invention includes: a fuel injection valve that injects a fuel into the engine; a downstream side air-fuel ratio sensor that is disposed downstream of a catalyst disposed in an exhaust passage of the engine and outputs an output value corresponding to an air-fuel ratio of a gas flowing out of the catalyst; a correction amount calculation unit; a learning unit; and a fuel injection control unit.

During a period in which a predetermined downstream side feedback condition (a sub-feedback control condition) is established, the correction amount calculation unit (1) calculates a proportional term by multiplying by a predetermined proportional gain an output deviation, which is a "deviation between the output value of the downstream side air-fuel ratio sensor and a predetermined downstream side target value", (2) calculates a time integrated value by integrating a value obtained by multiplying by a predetermined adjustment gain the output deviation, and calculates a value that is commensurate with the calculated time integrated value as an integral term, and (3) calculates an air-fuel ratio feedback amount for feedback-correcting an amount of the fuel to be injected from the fuel injection value, or in other words a correction amount for aligning the output value of the downstream side air-fuel ratio sensor with the downstream side target value, on the basis of at least the proportional term and the integral term.

The learning unit obtains a value that correlates with the calculated integral term as a learned value. In other words, the learning unit may obtain the time integrated value, the integral term, and a value (a first order delay filter processing value of the integral term, for example) that varies in accordance therewith as the learned value.

The fuel injection control unit calculates a final fuel injection amount on the basis of at least the air-fuel ratio feedback amount when the downstream side feedback condition is established. The fuel injection control unit calculates the final fuel injection amount on the basis of at least the learned value when the downstream side feedback condition is not established. Further, the fuel injection control unit causes the fuel in the calculated final fuel injection amount to be injected from the fuel injection value.

Further, the learning unit is configured to determine that the learned value has converged (1) when the learned value exists between a predetermined upper limit value and a predetermined lower limit value for a predetermined time, or (2) when a variation amount of the learned value over the predetermined time is smaller than a determination threshold width.

Furthermore, the correction amount calculation unit is configured to set the proportional gain at a smaller value after the learned value is determined to have converged than before the learned value is determined to have converged, and to set the adjustment gain at a smaller value after the learned value is determined to have converged than before the learned value is determined to have converged.

According to this constitution, the adjustment gain is set at a relatively large value during a period in which the learned value greatly diverges from the convergence value (see a first period in FIG. 4A), and therefore the learned value can be brought close to the convergence value quickly. Meanwhile, the proportional gain is maintained at a comparatively large value during this period. However, the integral term diverges comparatively greatly from the intended convergence value during this period, and therefore a ratio between "a time during which the output value of the downstream side air-fuel ratio sensor corresponds to a rich air-fuel ratio" and a predetermined unit time is unlikely to be affected by the magnitude of the proportional gain. Therefore, the magnitude of the proportional gain does not have a large effect on the update speed of the learned value.

Thereafter, the learned value approaches the convergence value. In this case also, the proportional gain is set at a comparatively large value. As a result, as shown from the time t0 to the time t4 in FIG. 4B, the inversion period of the output value of the downstream side air-fuel ratio sensor decreases, and therefore the variation amount of the learned value becomes comparatively small.

Hence, a timing at which the learned value exists "between the predetermined upper limit value and the predetermined lower limit value" for the predetermined time arrives early. As a result, in a case where the learning unit is configured to determine that the learned value has converged when the learned value exists "between the predetermined upper limit value and the predetermined lower limit value" for the predetermined time, the learning unit can "determine that the learned value has converged" earlier.

Likewise according to this constitution, a timing at which the variation amount of the learned value over the predetermined time is smaller than the determination threshold width arrives early. As a result, in a case where the learning unit is configured to determine that the learned value has converged when the variation amount of the learned value over the predetermined time is smaller than the determination threshold width, the learning unit can "determine that the learned value has converged" earlier.

Further, according to this constitution, the proportional gain after the learned value is determined to have converged is set at a smaller value than the proportional gain before the learned value is determined to have converged. As a result, as shown from the time t4 onward in FIG. 4B, the inversion period of the output value of the downstream side air-fuel ratio sensor lengthens. Accordingly, the frequency with which the oxygen storage amount of the catalyst reaches "0" or the maximum oxygen storage amount Cmax decreases, and therefore emissions can be reduced.

Furthermore, the adjustment gain after the learned value is determined to have converged is set at a smaller value than the adjustment gain before the learned value is determined to have converged. As a result, as shown by a dotted line from the time t4 onward in FIG. 4B, the variation amount of the learned value decreases even when the inversion period of the output value of the downstream side air-fuel ratio sensor lengthens. Hence, a situation in which the learned value is determined not to have converged again can be avoided.

Incidentally, when the air-fuel ratio flowing into the catalyst takes "a certain value", the amount of "excessive oxygen or excessive unburned material" flowing into the catalyst increases as the intake air amount increases. Accordingly, the variation speed of the oxygen storage amount of the catalyst increases as the intake air amount increases. Therefore, as shown in FIG. 17, in a case where the proportional gain is maintained at a constant value regardless of the intake air amount, the inversion period of the output value of the downstream side air-fuel ratio sensor when the intake air amount is small (from the time t4 onward) is longer than the inversion period of the output value of the downstream side air-fuel ratio sensor when the intake air amount is large (from the time t1 to the time t4). As a result, the variation amount of the learned value (the sub-FB learned value) increases (see variation amounts D1 and D2) when the intake air amount is small.

Hence, the correction amount calculation unit may be configured to increase the proportional gain as the intake air amount of the engine decreases before the learned value is determined to have converged. For example, the proportional gain is set to be inversely proportionate to the intake air amount.

As a result, as shown in FIG. 18, the inversion period of the output value of the downstream side air-fuel ratio sensor can be kept substantially constant even when the intake air amount Ga varies (see before and after a time t4). Hence, the variation amount of the learned value does not increase even when the intake air amount decreases, and therefore the learning unit can "determine that the learned value has converged" early.

Furthermore, even when the air-fuel ratio of the gas flowing into the catalyst and the intake air amount are constant, the inversion period of the output value of the downstream side air-fuel ratio sensor shortens as deterioration of the catalyst advances. The reason for this is that as deterioration of the catalyst advances, the maximum oxygen storage amount Cmax of the catalyst decreases such that the oxygen storage amount reaches "0" or the maximum oxygen storage amount Cmax early.

Hence, the correction amount calculation unit may be configured to obtain a catalyst deterioration index value indicating a degree of deterioration of the catalyst, and determine the proportional gain on the basis of the catalyst deterioration index value such that the proportional gain decreases as the degree of deterioration of the catalyst advances.

As a result, the inversion period of the output value of the downstream side air-fuel ratio sensor can be kept substantially constant regardless of the degree of deterioration of the catalyst. Hence, the variation amount of the learned value can be kept substantially constant once the learned value has substantially converged, regardless of the degree of deterioration of the catalyst, and therefore the learning unit can "determine that the learned value has converged" early.

The correction amount calculation unit may be configured to increase the proportional gain as an intake air amount of the engine decreases, regardless of whether or not the learned value is determined to have converged.

As a result, before the learned value is determined to have converged, the variation amount of the learned value does not increase even when the intake air amount decreases, and therefore the learning unit can "determine that the learned value has converged" early. Further, even when the intake air amount varies after the learned value is determined to have converged, the inversion period of the output value of the downstream side air-fuel ratio sensor can be set at an appropriate period in terms of emissions. Hence, the determination as to whether or not the learned value has converged can be made quickly and precisely, and emissions can be reduced after the learned value is determined to have converged.

Note that the learning unit may be configured to determine that the learned value has converged when the learned value exists between the upper limit value and the lower limit value for the predetermined time, to set the upper limit value as a value obtained by adding a positive specific value to a determination reference value, which is a variation center of a past value of the learned value, calculated on the basis of the past value of the learned value, and to set the lower limit value as a value obtained by subtracting the positive specific value from the determination reference value.

It may be said that the learning unit is "configured to determine that the learned value has converged when a difference between the determination reference value and a newest value of the learned value is smaller than a predetermined threshold (the aforesaid specific value) for a predetermined determination period". In other words, when the difference between the determination reference value and the newest value of the learned value is larger than the threshold, the learning unit determines that the learned value has not converged.

According to this constitution, a determination is made as to whether or not a deviation from the determination reference value of the learned value during the predetermined period exceeds the specific value, and therefore the determination as to whether or not the learned value has converged can be made in a shorter amount of time than when a determination is made as to whether or not the variation amount of the learned value over the predetermined period exceeds a threshold.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIGS. 4A and 4B are time charts showing variation in the output value of the downstream side air-fuel ratio sensor, a sub-FB learned value, and so on;

FIG. 10 is a flowchart showing a routine executed by the CPU of the first control apparatus;

DETAILED DESCRIPTION OF EMBODIMENTS

A fuel injection amount control apparatus (to be referred to simply as a "control apparatus" hereafter) for an internal combustion engine according to embodiments of the invention will be described below with reference to the drawings. This control apparatus is also an air-fuel ratio control apparatus for an internal combustion engine.

First Embodiment (Configuration)

Figure 1:
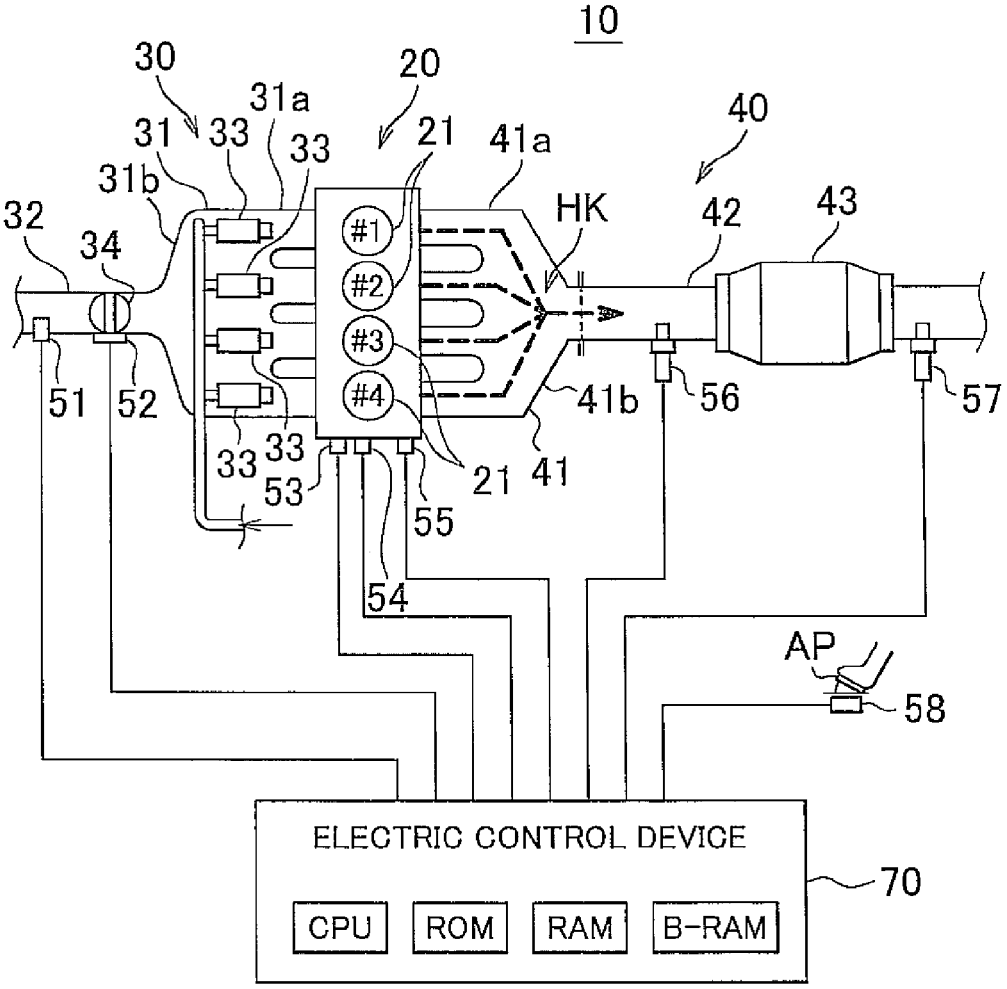
FIG. 1 is a schematic view of an internal combustion engine to which a fuel injection amount control apparatus (a first control apparatus) according to a first embodiment of the invention is applied.

FIG. 1 shows an outline of the configuration of a system in which a control apparatus according to a first embodiment (to be referred to hereafter as a "first control apparatus") is applied to a four-cycle, spark ignition, multi-cylinder (inline four cylinder) internal combustion engine 10.

The internal combustion engine 10 includes an engine main body portion 20, an intake system 30, and an exhaust system 40.

The engine main body portion 20 includes a cylinder block portion and a cylinder head portion. The engine main body portion 20 includes a plurality of cylinders (combustion chambers) 21. Each cylinder communicates with "an intake port and an exhaust port", not shown in the drawing. A communication portion between the intake port and the combustion chamber 21 is opened and closed by an intake valve, not shown in the drawing. A communication portion between the exhaust port and the combustion chamber 21 is opened and closed by an exhaust valve, not shown in the drawing. A spark plug, not shown in the drawing, is disposed in each combustion chamber 21.

The intake system 30 includes an intake manifold 31, an intake pipe 32, a plurality of fuel injection valves 33, and a throttle valve 34.

The intake manifold 31 includes a plurality of branch portions 31*a* and a surge tank 31*b*. One end of each of the plurality of branch portions 31*a* is connected to one of the plurality of intake ports. The respective other ends of the plurality of branch portions 31*a* are connected to the surge tank 31*b*.

One end of the intake pipe 32 is connected to the surge tank 31*b*. An air filter, not shown in the drawing, is disposed on the other end of the intake pipe 32.

One fuel injection valve 33 is provided for each cylinder (combustion chamber) 21. The fuel injection valve 33 is provided in the intake port. In other words, each of the plurality of cylinders is provided with the fuel injection valve 33 for supplying fuel thereto independently of the other cylinders. In response to an injection instruction signal, the fuel injection valve 33 injects "fuel in an instructed fuel injection amount included in the injection instruction signal" into the intake port (in other words, the cylinder 21 corresponding to the fuel injection valve 33).

The throttle valve 34 is disposed rotatably in the intake pipe 32. The throttle valve 34 is configured to be capable of varying an opening area of an intake passage. The throttle valve 34 is driven to rotate within the intake pipe 32 by a throttle valve actuator, not shown in the drawing.

The exhaust system 40 includes an exhaust manifold 41, an exhaust pipe 42, an upstream side catalyst 43 disposed in the exhaust pipe 42, and a "downstream side catalyst, not shown in the drawing", which is disposed in the exhaust pipe 42 downstream of the upstream side catalyst 43.

The exhaust manifold 41 includes a plurality of branch portions 41*a* and a gathering portion 41*b*. One end of each of the plurality of branch portions 41*a* is connected to one of the plurality of exhaust ports. The respective other ends of the plurality of branch portions 41*a* gather in the gathering portion 41*b*. The gathering portion 41*b* is a part where exhaust gas discharged from a plurality of cylinders (two or more cylinders, four in this example) gathers, and will therefore also be referred to as an exhaust gas gathering portion HK.

The exhaust pipe 42 is connected to the gathering portion 41*b*. The exhaust ports, the exhaust manifold 41, and the exhaust pipe 42 together form an exhaust passage.

The upstream side catalyst 43 and the downstream side catalyst are respectively so-called three-way catalyst devices (exhaust gas purification catalysts) carrying an active component constituted by a precious metal (a catalytic material) such as platinum, rhodium, or palladium. Each catalyst has a function for oxidizing unburned components such as HC, CO, and $H_2$ and reducing nitrogen oxide (NOx) when an air-fuel ratio of a gas flowing into each catalyst is within "an air-fuel ratio window of a three-way catalyst (the stoichiometric air-fuel ratio, for example)". This function will be referred to as a catalyst function. Further, each catalyst has an oxygen storage (discharge) function for storing oxygen and discharging oxygen if necessary. Due to the oxygen storage function, each catalyst is capable of purifying unburned components and nitrogen oxide even when the air-fuel ratio is displaced from the stoichiometric air-fuel ratio. In other words, the width of the window is enlarged by the oxygen storage function. The oxygen storage function is realized by an oxygen storage material such as ceria ($CeO_2$) carried on the catalyst.

The system includes a hot wire type air flow meter 51, a throttle position sensor 52, a water temperature sensor 53, a crank position sensor 54, an intake cam position sensor 55, an upstream side air-fuel ratio sensor 56, a downstream side air-fuel ratio sensor 57, and an accelerator opening sensor 58.

The air flow meter 51 outputs a signal corresponding to a mass flow rate (an intake air flow rate) Ga of intake air flowing through the intake pipe 32. In other words, the intake air amount Ga represents an amount of intake air taken into the engine 10 per unit time.

The throttle position sensor 52 detects an opening (a throttle valve opening) of the throttle valve 34 and outputs a signal indicating a throttle valve opening TA.

The water temperature sensor 53 detects a temperature of cooling water in the internal combustion engine 10 and outputs a signal indicating a cooling water temperature THW. The cooling water temperature THW is a parameter representing a warm-up condition of the engine 10 (a temperature of the engine 10).

The crank position sensor 54 outputs a signal having a narrow pulse width every time a crankshaft rotates 10° and having a wide pulse width every time the crankshaft rotates 360°. This signal is converted into an engine rotation speed NE by an electric control device 70 to be described below.

The intake cam position sensor 55 outputs a single pulse every time an intake camshaft rotates 90 degrees, a further 90 degrees, and a further 180 degrees from a predetermined angle. On the basis of the signals from the crank position sensor 54 and the intake cam position sensor 55, the electric control device 70, to be described below, obtains an absolute crank angle CA having compression top dead center of a reference cylinder (a first cylinder, for example) as a reference. The absolute crank angle CA is set at "0° crank angle" at compression top dead center of the reference cylinder, increases to 720° crank angle in accordance with the rotation angle of the crankshaft, and at that point is set back at 0° crank angle.

The upstream side air-fuel ratio sensor 56 is disposed in "one of the exhaust manifold 41 and the exhaust pipe 42" in a position between the gathering portion 41*b* (the exhaust gas gathering portion HK) of the exhaust manifold 41 and the upstream side catalyst 43.

The upstream side air-fuel ratio sensor 56 is a "limiting current type wide area air-fuel ratio sensor having a diffusion resistance layer" disclosed in Japanese Patent Application Publication No. 11-72473 (JP-A-11-72473), Japanese Patent Application Publication No. 2000-65782 (JP-A-2000-65782), Japanese Patent Application Publication No. 2004-69547 (JP-A-2004-69547), and so on, for example.

Figure 2:
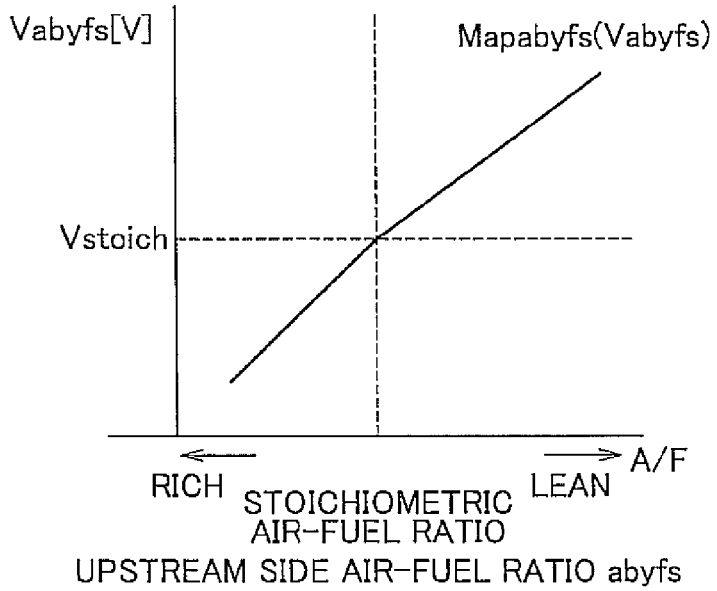
FIG. 2 is a graph showing a relationship between an output value of an upstream side air-fuel ratio sensor shown in FIG. 1 and an air-fuel ratio.

As shown in FIG. 2, the upstream side air-fuel ratio sensor 56 outputs an output value Vabyfs corresponding to the air-fuel ratio of the exhaust gas flowing in the disposal position of the upstream side air-fuel ratio sensor 56 as an "air-fuel ratio sensor output". The output value Vabyfs increases as the air-fuel ratio of the exhaust gas that reaches the upstream side air-fuel ratio sensor 56 increases (becomes leaner). When the air-fuel ratio of the exhaust gas that reaches the upstream side air-fuel ratio sensor 56 is at the stoichiometric air-fuel ratio, the output value Vabyfs matches a stoichiometric air-fuel ratio corresponding value Vstoich.

The electric control device 70, to be described below, stores the relationship shown in FIG. 2 in a read-only memory (ROM) as an "air-fuel ratio conversion table Mapabyfs (Vabyfs)", and obtains an upstream side air-fuel ratio abyfs (detected air-fuel ratio abyfs) by applying the actual output value Vabyfs to the air-fuel ratio conversion table Mapabyfs (Vabyfs).

Referring back to FIG. 1, the downstream side air-fuel ratio sensor 57 is disposed in the exhaust pipe 42. The downstream side air-fuel ratio sensor 57 is disposed on the downstream side of the upstream side catalyst 43 and on the upstream side of the downstream side catalyst (in other words, in the exhaust passage between the upstream side catalyst 43 and the downstream side catalyst). The downstream side air-fuel ratio sensor 57 is an electromotive force type oxygen concentration sensor (a concentration cell type oxygen concentration sensor employing a solid electrolyte such as stabilized zirconia). The downstream side air-fuel ratio sensor 57 generates an output value Voxs corresponding to the air-fuel ratio of detected gas, which is gas passing through the site of the exhaust passage in which the downstream side air-fuel ratio sensor 57 is disposed. In other words, the output value Voxs is a value corresponding to the air-fuel ratio (a downstream side air-fuel ratio afdown) of the gas that flows out of the upstream side catalyst 43 and flows into the downstream side catalyst.

Figure 3:
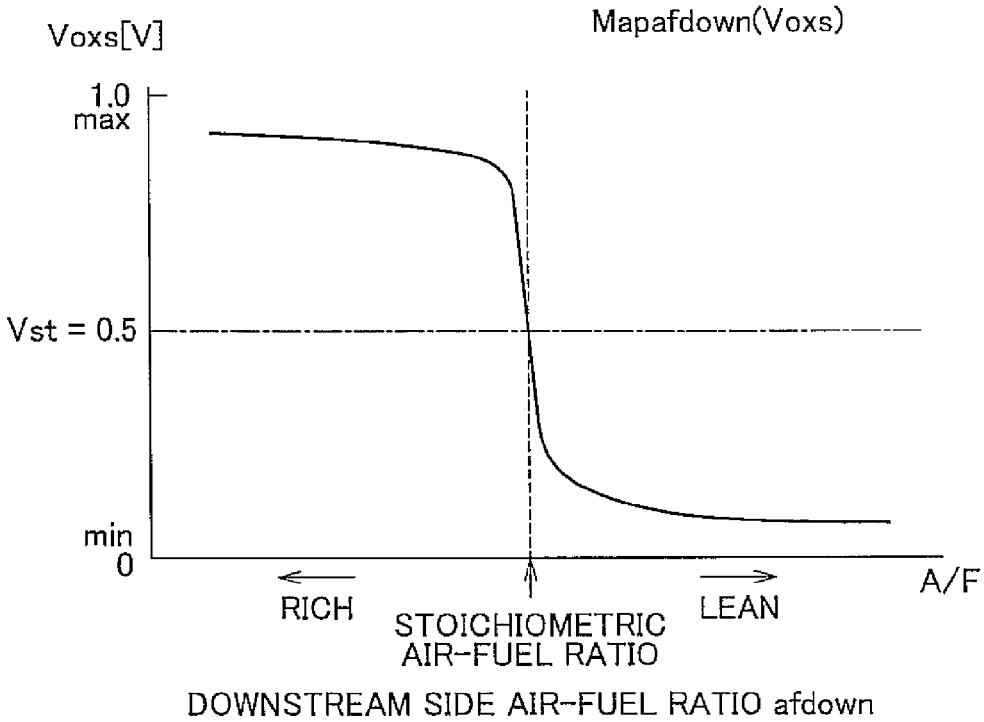
FIG. 3 is a graph showing a relationship between an output value of a downstream side air-fuel ratio sensor shown in FIG. 1 and the air-fuel ratio.

As shown in FIG. 3, the output value Voxs takes a maximum output value max (between approximately 0.9 V and 1.0 V, for example) when the air-fuel ratio of the detected gas is richer than the stoichiometric air-fuel ratio and takes a minimum output value min (approximately 0.1 V to 0 V, for example) when the air-fuel ratio of the detected gas is leaner than the stoichiometric air-fuel ratio. Further, the output value Voxs takes a voltage Vst (intermediate voltage Vst, approximately 0.5 V, for example) that is substantially midway between the maximum output value max and the minimum output value min when the air-fuel ratio of the detected gas is the stoichiometric air-fuel ratio. The output value Voxs varies rapidly from the maximum output value max to the minimum output value min when the air-fuel ratio of the detected gas varies from a richer air-fuel ratio than the stoichiometric air-fuel ratio to a leaner air-fuel ratio than the stoichiometric air-fuel ratio. Similarly, the output value Voxs varies rapidly from the minimum output value min to the maximum output value max when the air-fuel ratio of the detected gas varies from a leaner air-fuel ratio than the stoichiometric air-fuel ratio to a richer air-fuel ratio than the stoichiometric air-fuel ratio.

The accelerator opening sensor 58 shown in FIG. 1 outputs a signal indicating an operation amount Accp of an accelerator pedal AP operated by a driver (an accelerator pedal operation amount, an opening of the accelerator pedal AP). The accelerator pedal operation amount Accp increases as the operation amount of the accelerator pedal AP increases.

The electric control device 70 is a microcomputer constituted by "a CPU, a ROM storing programs executed by the CPU, tables (maps, functions), constants, and so on in advance, a RAM that stores data temporarily in accordance with the needs of the CPU, a backup RAM, an interface including an analogue to digital (AD) converter, and so on".

The backup RAM receives a supply of power from a battery installed in a vehicle installed with the engine 10 regardless of the position (one of an OFF position, a start position, an ON position, and so on) of an ignition key switch, not shown in the drawing, of the vehicle. While receiving the supply of power from the battery, the backup RAM stores data (data is written thereto) in accordance with an instruction from the CPU and holds (stores) these data readably. Hence, the backup RAM is capable of holding data even when the engine 10 is inoperative.

When the battery is removed from the vehicle or the like such that the power supply from the battery to the backup RAM is interrupted, the backup RAM cannot hold data. Therefore, when the power supply to the backup RAM is restarted, the CPU initializes (sets at a default value) the data to be held in the backup RAM. Note that the backup RAM may be a readable/writable non-volatile memory such as an electrically erasable programmable read-only memory (EEPROM).

The electric control device 70 is connected to the sensors and so on described above in order to supply the CPU with signals from the sensors. Further, the electric control device 70 transmits drive signals (instruction signals) to the spark plug (in actuality, an igniter) provided for each cylinder, the fuel injection valve 33 provided for each cylinder, the throttle valve actuator, and so on in accordance with instructions from the CPU.

Note that the electric control device 70 transmits an instruction signal to the throttle valve actuator to increase the throttle valve opening TA as the obtained accelerator pedal operation amount Accp increases. In other words, the electric control device 70 includes a throttle valve driving unit that modifies the opening of the "throttle valve 34 disposed in the intake passage of the engine 10" in accordance with an acceleration operation amount (the accelerator pedal operation amount Accp) of the engine 10 modified by the driver.

(Outline of Air-Fuel Ratio Control Performed by First Control Apparatus)

The first control apparatus performs main feedback control to align the upstream side air-fuel ratio abyfs indicated by the output value Vabyfs of the upstream side air-fuel ratio sensor 56 with a predetermined target air-fuel ratio abyfr. Further, the first control apparatus performs sub-feedback control to align the output value Voxs of the downstream side air-fuel ratio sensor 57 with a predetermined downstream side target value Voxsref. By performing the main feedback control and the sub-feedback control, the fuel injection amount is feedback-corrected.

In the sub-feedback control, a sub-feedback amount KSFB is calculated. The sub-feedback amount KSFB acts to modify the target air-fuel ratio abyfr. Note, however, that the sub-feedback amount KSFB may act to correct the output value Vabyfs of the upstream side air-fuel ratio sensor 56, thereby substantially modifying the target air-fuel ratio abyfr.

The first control apparatus calculates the sub-feedback amount KSFB through PID control based on a "difference (an output deviation DVoxs) between the output value Voxs and the downstream side target value Voxsref". Therefore, the sub-feedback amount KSFB includes a proportional term, an integral term, and a derivative term.

To calculate the proportional term of the sub-feedback amount KSFB, the first control apparatus calculates a value that correlates with the output deviation DVoxs (in actuality, a value DVoxslow obtained by subjecting the output deviation DVoxs to low pass filter processing), and calculates the proportional term (=kp×DVoxslow) by multiplying this value (DVoxslow) by a proportional gain Kp. Note that the value DVoxslow may essentially be referred to as a deviation (an output deviation) between the output value Voxs and the downstream side target value Voxsref.

Further, to calculate the integral term of the sub-feedback amount KSFB, the first control apparatus determines a time integrated value SDVoxslow by integrating a value K×DVoxslow obtained by multiplying a predetermined adjustment gain K by the value DVoxslow obtained by subjecting the output deviation DVoxs to low pass filter processing. Furthermore, the first control apparatus determines the integral term of the sub-feedback amount KSFB by multiplying an integral gain Ki by the time integrated value SDVoxslow. Note that in this example, the integral gain Ki is "1", and it may therefore be said that the first control apparatus calculates a value that is commensurate with the time integrated value SDVoxslow as the integral term.

The first control apparatus obtains a value corresponding to the integral term of the sub-feedback amount KSFB (in this example, the integral term Ki×SDVoxslow itself) as a learned value of the sub-feedback amount (a sub-FB learned value KSFBg). The sub-FB learned value KSFBg is stored in the backup RAM and used to correct the fuel injection amount at least "when a sub-feedback control condition for updating the sub-feedback amount is not established".

Meanwhile, the first control apparatus determines a variation center (a weighted average of the sub-FB learned value KSFBg) of the sub-FB learned value KSFBg from a predetermined past time to the present as a determination reference value Vkijun. The first control apparatus then determines a value obtained by adding a positive specific value ΔV (ΔV1, ΔV2, and so on) to the determination reference value Vkijun as an upper limit value Vgmaxth, and determines a value obtained by subtracting the specific value ΔV from the determination reference value Vkijun as a lower limit value Vgminth.

When "the sub-FB learned value KSFBg exists between the upper limit value Vgmaxth and the lower limit value Vgminth" for a predetermined period, the first control apparatus determines that a degree of convergence of the sub-FB learned value KSFBg has increased (i.e. that the learned value has come closer to the convergence value). Conversely, when "the sub-FB learned value KSFBg ceases to exist between the upper limit value Vgmaxth and the lower limit value Vgminth" within the predetermined period, the first control apparatus determines that the degree of convergence of the sub-FB learned value KSFBg has decreased (i.e. that the learned value has diverged from the convergence value). The degree of convergence of the sub-FB learned value KSFBg is indicated by a status value to be described below.

Status 0 (when the status is "0"): The convergence condition of the sub-FB learned value KSFBg is unfavorable. More specifically, a status 0 condition means that the sub-FB learned value KSFBg is in an "unstable condition", i.e. the sub-FB learned value KSFBg "has diverged from a convergence value ki×SDVoxsfinal" and "a variation speed of the sub-FB learned value KSFBg is high".

Status 2 (when the status is "2"): The convergence condition of the sub-FB learned value KSFBg is favorable. More specifically, a status 2 condition means that the sub-FB learned value KSFBg is in a "stable condition", i.e. the sub-FB learned value KSFBg "has stabilized in the vicinity of the convergence value ki×SDVoxsfinal". In other words, the stable condition indicates that learning of the sub-FB learned value KSFBg is complete.

Status 1 (when the status is "1"): The convergence condition of the sub-FB learned value KSFBg is between the stable condition and the unstable condition (i.e. a semi-stable condition).

Figure 4A:
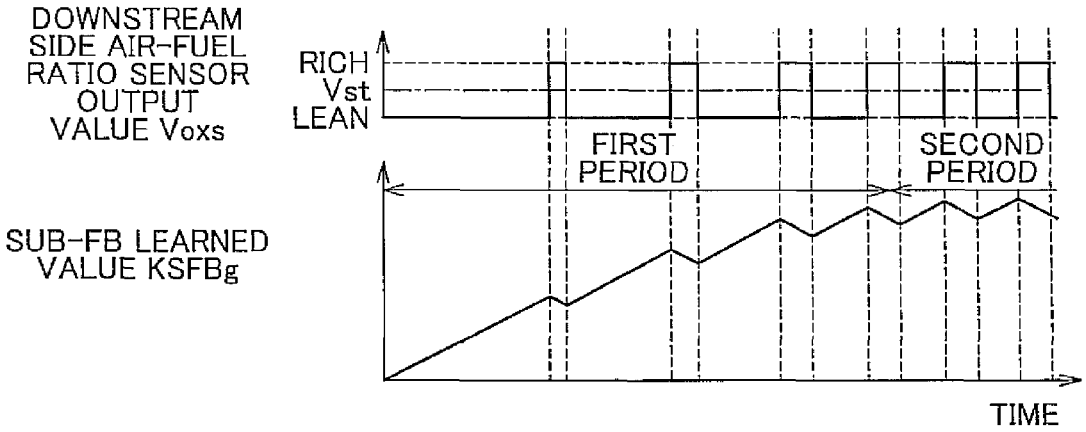
Figure 4B:
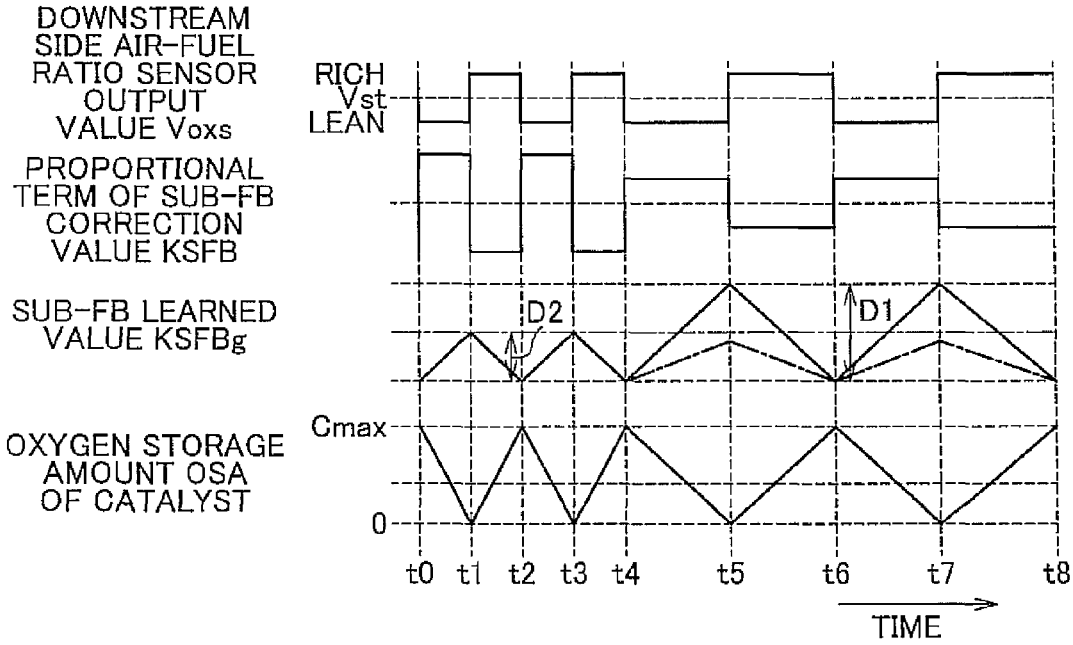

As shown in FIG. 4B, when the sub-FB learned value KSFBg has substantially converged, a variation amount of the sub-FB learned value KSFBg varies substantially dependently on the magnitude of "the proportional term of the sub-feedback amount".

The reason for this may be described briefly as follows.

As noted above, the sub-feedback amount KSFB is a sum of the proportional term, the integral term, and the derivative term (and in this example, also the sub-FB learned value KSFBg). Typically, the proportional term has a greater magnitude than the other terms. Alternatively, when the sub-FB learned value KSFBg has substantially converged, the integral value and the sub-FB learned value KSFBg take values required to maintain a center of the air-fuel ratio of the engine in the vicinity of the stoichiometric air-fuel ratio. Hence, the proportional term serves as a principal element for modifying the air-fuel ratio of the engine to "a richer air-fuel ratio than the stoichiometric air-fuel ratio and a leaner air-fuel ratio than the stoichiometric air-fuel ratio".

Therefore, when the magnitude of the proportional term of the sub-feedback amount KSFB (and therefore the magnitude of the proportional gain) is large, as shown at and before the time t4 in FIG. 4B, an oxygen storage amount of the catalyst 43 reaches "0" or a maximum oxygen storage amount Cmax in a short time. Accordingly, when the magnitude of the proportional term of the sub-feedback amount KSFB is large, a time during which the time integrated value varies continuously in a single direction (an increasing direction, for example) decreases, and as a result, a variation amount D2 of the sub-FB learned value KSFBg also decreases.

When the magnitude of the proportional term of the sub-feedback amount KSFB (and therefore the magnitude of the proportional gain) is small, on the other hand, as shown from the time t4 onward in FIG. 4B, the amount of time required for the oxygen storage amount of the catalyst 43 to reach "0" or the maximum oxygen storage amount Cmax increases. Accordingly, when the magnitude of the proportional term of the sub-feedback amount KSFB is small, the time during which the time integrated value varies continuously in a single direction (the increasing direction, for example)

increases, and as a result, a variation amount D1 of the sub-FB learned value KSFBg increases.

Hence, in an apparatus that determines that the sub-FB learned value KSFBg has converged when the sub-FB learned value KSFBg exists between a predetermined upper limit value and a predetermined lower limit value for a predetermined time or when the variation amount of the sub-FB learned value KSFBg within the predetermined time is smaller than a determination threshold width, the proportional gain, which substantially determines the magnitude of the proportional term, is preferably set at a small value so that the determination that the sub-FB learned value KSFBg has converged can be made earlier.

However, NOx and unburned material are discharged from the catalyst 43 every time an oxygen storage amount OSA of the catalyst 43 reaches the "maximum oxygen storage amount Cmax" and "0", respectively. It is therefore undesirable in terms of reducing emissions to continue to set the proportional gain at a large value even after the sub-FB learned value KSFBg is determined to have converged.

Hence, the first control apparatus reduces the proportional gain as the degree of convergence of the sub-FB learned value KSFBg advances (as the sub-feedback amount KSFB approaches the convergence value). More specifically, the first control apparatus sets the proportional gain Kp when the status is "2" at a smaller value than the proportional gain Kp when the status is "1", and sets the proportional gain Kp when the status is "1" at a smaller value than the proportional gain Kp when the status is "0".

Thus, the variation amount of the sub-FB learned value KSFBg within the predetermined period decreases before the sub-FB learned value KSFBg is determined to have converged (before the status is determined to be at "2", for example), making it possible to determine earlier that the sub-FB learned value KSFBg has converged. Moreover, the frequency with which the oxygen storage amount OSA of the catalyst 43 reaches the "maximum oxygen storage amount Cmax" and "0" decreases (the aforementioned inversion period of the output value Voxs increases in length) after the sub-FB learned value KSFBg is determined to have converged (after the status is determined to be at "2", for example), and therefore emissions can be reduced.

Meanwhile, the first control apparatus reduces the adjustment gain K as the degree of convergence of the sub-FB learned value KSFBg advances. More specifically, the first control apparatus sets the adjustment gain K when the status is "2" at a smaller value than the adjustment gain K when the status is "1", and sets the adjustment gain K when the status is "1" at a smaller value than the adjustment gain K when the status is "0".

Thus, the sub-FB learned value KSFBg can be brought close to an appropriate value (the intended convergence value) more quickly before the sub-FB learned value KSFBg is determined to have converged (when the status is at "0" or "1"), and after the sub-FB learned value KSFBg is determined to have converged (after the status has shifted to "2"), the sub-FB learned value KSFBg can be maintained in the vicinity of an appropriate value with stability.

(Details of Air-Fuel Ratio Control)

Next, the air-fuel ratio control performed on the engine by the first control apparatus will be described in detail. As noted above, the first control apparatus executes sub-feedback control for aligning the output value Voxs of the downstream side air-fuel ratio sensor 57 with the downstream side target value Voxsref.

Meanwhile, the upstream side catalyst 43 has an oxygen storage function, and therefore air-fuel ratio variation upstream of the upstream side catalyst 43 appears as air-fuel ratio variation downstream of the upstream side catalyst 43 following the elapse of a predetermined delay. It is therefore difficult to suppress transitional air-fuel ratio variation sufficiently with the sub-feedback control alone. Hence, as described above, the first control apparatus executes air-fuel ratio feedback control (the main feedback control) based on the output value Vabyfs of the upstream side air-fuel ratio sensor 56.

The first control apparatus performs air-fuel ratio control using an in-cylinder intake air amount calculation unit A1 and so on, to be described below, in order to prevent a situation in which the air-fuel ratio of the engine is reduced by the sub-feedback control when the air-fuel ratio of the engine is increased by the main feedback control and a situation in which the air-fuel ratio of the engine is increased by the sub-feedback control when the air-fuel ratio of the engine is reduced by the main feedback control. As a result, control interference does not occur between the main feedback control and the sub-feedback control.

Figure 5:
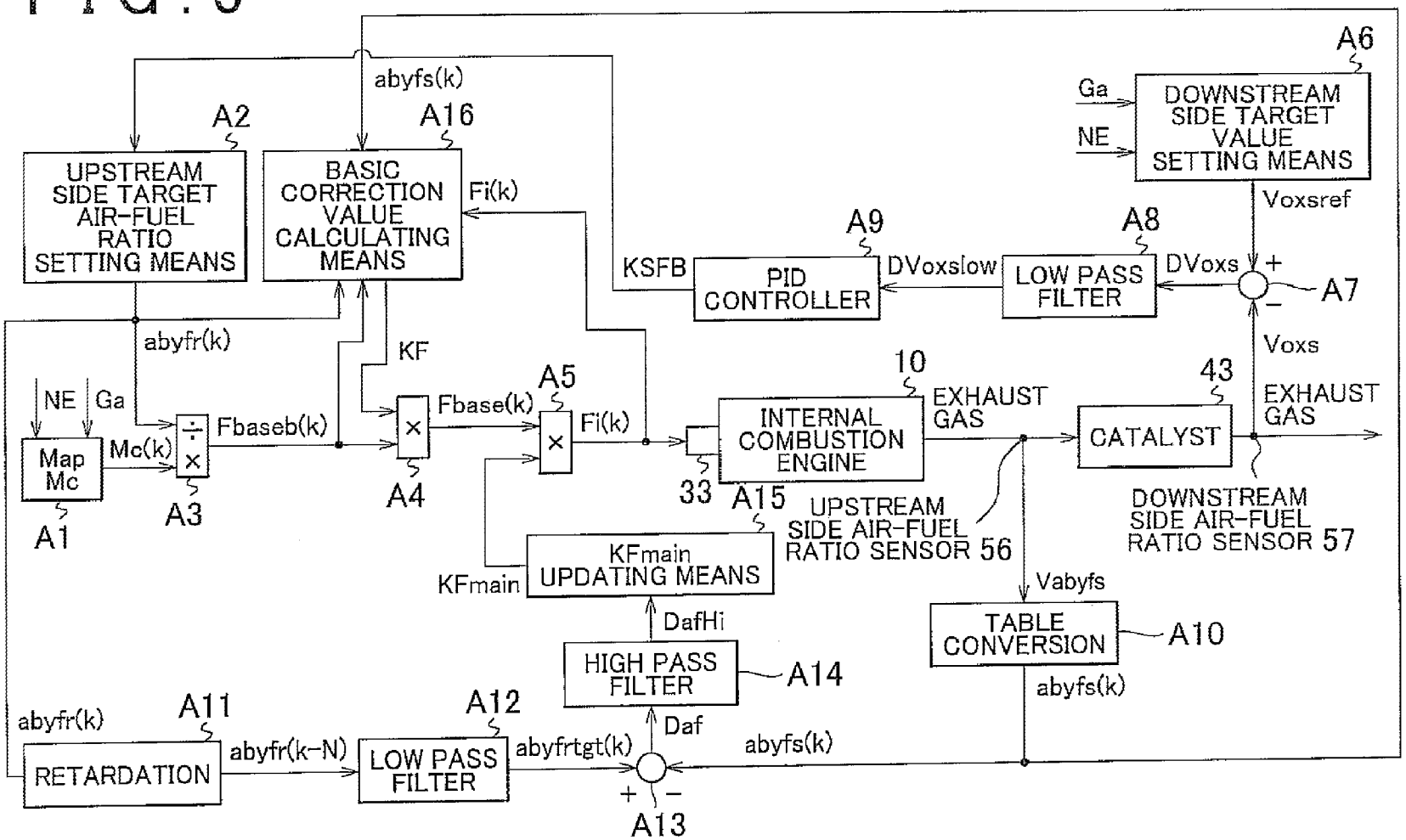
FIG. 5 is a functional block diagram showing functions exhibited when an electric control device shown in FIG. 1 executes fuel injection amount control (air-fuel ratio control)

The first control apparatus is configured to include the in-cylinder intake air amount calculation unit A1 and so on, shown in the functional block diagram of FIG. 5. The following description will be provided with reference to FIG. 5.

[Calculation of Corrected Basic Fuel Injection Amount]

The in-cylinder intake air amount calculation unit A1 determines an in-cylinder intake air amount Mc (k), which is an intake air amount of a cylinder passing through a current intake stroke, on the basis of the actual intake air amount Ga, the actual engine rotation speed NE, and a lookup table MapMc stored in the ROM. Note that variables having the suffix (k) denote values corresponding to the current intake stroke (or the present time). A suffix (k−N) denotes values relating to an intake stroke performed N strokes (in a four cylinder engine, N×180° CA, CA: crank angle) before the current intake stroke. This notation method is used likewise with regard to other parameters hereafter. The in-cylinder intake air amount Mc (k) is stored in the RAM in association with the intake stroke of each cylinder.

An upstream side target air-fuel ratio setting (determination) unit A2 determines an upstream side target air-fuel ratio (target air-fuel ratio) abyfr (k) on the basis of operating conditions of the internal combustion engine 10 such as the engine rotation speed NE, an engine load (the throttle valve opening TA, for example), and so on. Note that in this example, the target air-fuel ratio abyfr is determined by correcting a reference air-fuel ratio abyfr0 set at the stoichiometric air-fuel ratio stoich using "the sub-feedback amount KSFB for realizing the sub-feedback control". In other words, the target air-fuel ratio abyfr is set at a value (AF0−KSFB) obtained by subtracting the sub-feedback amount KSFB from the reference air-fuel ratio abyfr0 set at the stoichiometric air-fuel ratio stoich. The upstream side target air-fuel ratio abyfr (k) is a value that serves as a basis for a target value of the detected air-fuel ratio abyfs obtained on the basis of the output value of the upstream side air-fuel ratio sensor 56. The target air-fuel ratio abyfr (k) is stored in the RAM in association with the intake stroke of each cylinder.

A pre-correction basic fuel injection amount calculation unit A3 determines a basic fuel injection amount Fbaseb (k) by dividing the in-cylinder intake air amount Mc (k) determined by the n-cylinder intake air amount calculation unit A1 by the upstream side target air-fuel ratio abyfr (k) set by the upstream side target air-fuel ratio setting unit A2, as shown in a following Equation (1). The basic fuel injection amount Fbaseb (k) is a basic fuel injection amount prior to correction by a basic correction value KF and so on, to be described below, and will therefore also be referred to as a pre-correction basic fuel injection amount Fbaseb (k). The pre-correction basic fuel injection amount Fbaseb (k) is stored in the RAM in association with the intake stroke of each cylinder.

$$Fbaseb(k)=Mc(k)/abyfr(k) \quad (1)$$

A corrected basic fuel injection amount calculation unit A4 determines a corrected basic fuel injection amount Fbase (k) (=KF×Fbaseb (k)) by multiplying the basic correction value KF by the current pre-correction basic fuel injection amount Fbaseb (k) determined by the pre-correction basic fuel injection amount calculation unit A3. The basic correction value KF is determined by a basic correction value calculation unit A16, to be described below, and stored in the backup RAM.

[Calculation of Final Fuel Injection Amount]

A final fuel injection amount calculation unit A5 determines a current final fuel injection amount Fi (k) by multiplying a main feedback amount KFmain by the corrected basic fuel injection amount Fbase (k) (=KF×Fbaseb (k)), as shown in a following Equation (2). The final fuel injection amount Fi (k) is stored in the RAM in association with the intake stroke of each cylinder. The main feedback amount KFmain is determined by a main feedback amount updating unit A15, to be described below.

$$Fi(k)=(KF\times Fbaseb(k))\times KFmain=Fbase(k)\times KFmain \quad (2)$$

The first control apparatus transmits an injection instruction signal to the fuel injection valve 33 of the cylinder passing through the current intake stroke so that the fuel injection valve 33 injects fuel in the final fuel injection amount Fi (k). In other words, the injection instruction signal includes information relating to the final fuel injection amount Fi (k) as an instructed fuel injection amount.

[Calculation of Sub-Feedback Amount]

A downstream side target value setting unit A6 determines a downstream side target value Voxsref corresponding to a downstream side target air-fuel ratio on the basis of "the engine rotation speed NE, the intake air amount Ga, the throttle valve opening TA, deterioration of the upstream side catalyst 43 (the maximum oxygen storage amount Cmax), and so on". In this example, the downstream side target value Voxsref is a value Vst corresponding to the stoichiometric air-fuel ratio. The downstream side target value Voxsref may take a different value to the value Vst corresponding to the stoichiometric air-fuel ratio as long as the value corresponds to an air-fuel ratio within the window of the catalyst 43.

An output deviation calculation unit A7 determines the output deviation DVoxs by subtracting the present output value Voxs of the downstream side air-fuel ratio sensor 57 from the present downstream side target value Voxsref set by the downstream side target value setting unit A6 on the basis of a following Equation (3). The "present" denotes an instructed injection start time of the current Fi (k). The output deviation calculation unit A7 outputs the determined output deviation DVoxs to a low pass filter A8.

$$DVoxs=Voxsref-Voxs \quad (3)$$

The low pass filter A8 is a first order digital filter. A transfer function A8 (s) representing a characteristic of the low pass filter A8 is shown in a following Equation (4). In Equation (4), s is a Laplacean operator, and τ1 is a time constant. The low pass filter A8 substantially prohibits passage of high-frequency components having a frequency of at least (1/τ1). The low pass filter A8 inputs the value of the output deviation DVoxs and outputs a low pass filter-passed output deviation DVoxslow, which is a "value obtained by subjecting the output deviation DVoxs to low pass filter processing", to a PID controller A9.

$$A8(s)=1/(1+\tau 1\times s) \quad (4)$$

The PID controller A9 calculates the time integrated value (an integration processing value) SDVoxslow by subjecting the low pass filter-passed output deviation DVoxslow to integration processing on the basis of a following Equation (5). SDVoxslow (n) on the left side is an updated time integrated value, while SDVoxslow (n−1) on the right side is a pre-update time integrated value. K is the adjustment gain (an adjustment value), which is set and modified in a manner to be described below. In other words, an update amount of the time integrated value SDVoxslow per update is a value K×DVoxslow obtained by multiplying the adjustment gain K by the output deviation DVoxslow. When the adjustment gain K is modified, an update speed (a reduction speed) of the time integrated value SDVoxslow changes.

$$SDVoxslow(n)=SDVoxslow(n-1)+K\times DVoxslow \quad (5)$$

Next, the PID controller A9 determines the sub-feedback amount KSFB by executing proportional-integral-derivative processing (PID processing) on the basis of a following Equation (6). In Equation (6), Kp is the proportional gain (a proportional constant), Ki is the integral gain (an integral constant), and Kd is a derivative gain (a derivative constant). DDVoxslow is a time integrated value of the low pass filter-passed output deviation DVoxslow. The sub-FB learned value KSFBg is a value obtained by extracting the integral term Ki×SDVoxslow every time a predetermined learning interval time Tth elapses. Through the processing described above, the sub-feedback amount KSFB is determined.

$$KSFB=Kp\times DVoxslow+Ki\times SDVoxslow+Kd\times DDVoxslow+KSFBg \quad (6)$$

Equation (6) includes the integral term Ki×SDVoxslow, and therefore the output deviation DVoxslow is guaranteed to reach zero in a steady state. In other words, a steady state deviation between the downstream side target value Voxsref and the output value Voxs of the downstream side air-fuel ratio sensor 57 reaches zero. Further, since the output deviation DVoxs reaches zero in a steady state, the proportional term Kp×DVoxslow and the derivative term Kd×DDVoxslow both reach zero. Hence, a steady state convergence value of the sub-feedback amount KSFB is equal to the sum of the integral term Ki×SDVoxslow and the sub-FB learned value KSFBg.

As is evident from the above description, the downstream side target value setting unit A6, the output deviation calculation unit A7, the low pass filter A8, and the PID controller A9 together form a sub-feedback amount calculation unit.

[Main Feedback Control]

As described above, the upstream side catalyst 43 has an oxygen storage function. Hence, "high-frequency components having a comparatively high frequency (the aforesaid high-frequency components having a frequency of at least 1/τ1)" and "low-frequency components having a comparatively low frequency and a comparatively small amplitude (low-frequency components that vary at a frequency of no more than the frequency 1/τ1 and exhibit comparatively small deviation from the stoichiometric air-fuel ratio)", within the air-fuel ratio variation of the exhaust gas upstream of the upstream side catalyst 43, are absorbed by the oxygen storage function of the upstream side catalyst 43, and are therefore unlikely to appear as air-fuel ratio variation in the exhaust gas downstream of the upstream side catalyst 43.

Accordingly, the sub-feedback control cannot be used to compensate for "rapid air-fuel ratio variation in a transitional operating condition" occurring such as, for example, the greater variation in the air-fuel ratio of the exhaust gas at a high frequency of at least the frequency (1/τ1). Therefore, to compensate for "rapid air-fuel ratio variation in a transitional operating condition" reliably, main feedback control must be performed on the basis of the output value Vabyfs of the upstream side air-fuel ratio sensor 56.

On the other hand, "low-frequency components having a comparatively low frequency and a comparatively large amplitude (for example, low-frequency components that vary at a frequency of no more than the frequency (1/τ1) and deviate comparatively greatly from the stoichiometric air-fuel ratio)", within the air-fuel ratio variation of the exhaust gas upstream of the upstream side catalyst 43, are not completely absorbed by the oxygen storage function of the upstream side catalyst 43. Hence, this type of air-fuel ratio variation upstream of the upstream side catalyst 43 appears as air-fuel ratio variation in the exhaust gas downstream of the upstream side catalyst 43 at the predetermined delay. As a result, a situation in which the output value Vabyfs of the upstream side air-fuel ratio sensor 56 shifts to the rich side of the target air-fuel ratio abyfr and the output value Voxs of the downstream side air-fuel ratio sensor 57 shifts to the lean side of the downstream side target value Voxsref or the like may occur, leading to the aforementioned control interference between the main feedback control and the sub-feedback control.

Hence, in the main feedback control, the first control apparatus uses a value corresponding to the output value Vabyfs of the upstream side air-fuel ratio sensor 56 after cutting "low-frequency components equal to or lower than a predetermined frequency (in this example, a frequency of (1/τ1)), which is a frequency component that may appear as air-fuel ratio variation downstream of the upstream side catalyst 43" from the respective frequency components of the variation in the output value Vabyfs of the upstream side air-fuel ratio sensor 56. The "value corresponding to the output value Vabyfs of the upstream side air-fuel ratio sensor 56" used in the main feedback control is a "value obtained by implementing high pass filter processing on a deviation Daf between a target air-fuel ratio abyfrtgt (k) and the output value Vabyfs (k)". As a result, the aforementioned air-fuel ratio control interference can be avoided, and rapid variation in the air-fuel ratio in a transitional operating condition can be compensated for reliably by the main feedback control. More specifically, the main feedback amount is determined in a following manner.

[Calculation of Main Feedback Amount]

A table conversion unit A10 determines the present detected air-fuel ratio abyfs (k) on the basis of the output value Vabyfs of the upstream side air-fuel ratio sensor 56 and the table Mapabyfs shown in FIG. 2.

A target air-fuel ratio retardation unit A11 reads an upstream side target air-fuel ratio abyfr obtained N strokes (N intake strokes) before the present, from among the upstream side target air-fuel ratios abyfr, from the RAM, and sets the read upstream side target air-fuel ratio abyfr as an upstream side target air-fuel ratio abyfr (k−N). The upstream side target air-fuel ratio abyfr (k−N) is an upstream side target air-fuel ratio used to calculate the pre-correction basic fuel injection amount Fbaseb (k−N) of the cylinder that passed through the intake stroke N strokes before the present.

The value N differs according to an exhaust gas amount generated by the internal combustion engine 10, a distance from the combustion chamber 21 to the upstream side air-fuel ratio sensor 56, and so on. The reason for using the actual upstream side target air-fuel ratio abyfr (k−N) obtained N strokes before the present to calculate the main feedback amount KFmain is that a dead time L1 corresponding to N strokes is required for an air-fuel mixture that contains the fuel injected from the fuel injection valve 33 and is burned in the combustion chamber 21 to reach the upstream side air-fuel ratio sensor 56. Note that the value N is preferably modified to be smaller as the engine rotation speed NE and the engine load (the in-cylinder intake air amount Mc, for example) increase.

A low pass filter A12 calculates a main feedback control target air-fuel ratio (an upstream side feedback control target air-fuel ratio) abyfrtgt (k) by implementing low pass filter processing on the upstream side target air-fuel ratio abyfr (k−N) output from the target air-fuel ratio retardation unit A11. The main feedback control target air-fuel ratio abyfrtgt (k) takes a value corresponding to the upstream side target air-fuel ratio abyfr (k) determined by the upstream side target air-fuel ratio setting unit A2.

The low pass filter A12 is a first order digital filter. A transfer characteristic A12 (s) of the low pass filter A12 is shown in a following Equation (7). In Equation (7), s is a Laplacean operator, and τ is a time constant (a parameter relating to responsiveness). With this characteristic, the low pass filter A12 substantially prohibits passage of high-frequency components having a frequency of at least (1/τ).

$$A12(s)=1/(1+\tau\times s) \tag{7}$$

When the value of the air-fuel ratio of the exhaust gas that reaches the upstream side air-fuel ratio sensor 56 is used as an input signal and the value of the air-fuel ratio determined on the basis of the output value Vabyfs of the upstream side air-fuel ratio sensor 56 is used as an output signal, the output signal is extremely similar to a signal obtained by implementing low pass filter processing (for example, first order delay processing, second order delay processing, and so on, including so-called "annealing processing") on the input signal. As a result, the main feedback control target air-fuel ratio abyfrtgt (k) generated by the low pass filter A12 takes a value to be actually outputted by the upstream side air-fuel ratio sensor 56 when exhaust gas having a desired air-fuel ratio corresponding to the target air-fuel ratio abyfr (k−N) reaches the upstream side air-fuel ratio sensor 56.

An upstream side air-fuel ratio deviation calculation unit A13 determines the air-fuel ratio deviation Daf by subtracting the present detected air-fuel ratio abyfs (k) from the main feedback control target air-fuel ratio abyfrtgt (k) on the basis of a following Equation (8). The air-fuel ratio deviation Daf is an amount expressing a deviation between an actual air-fuel ratio of an air-fuel mixture supplied to the cylinder N strokes previously and the target air-fuel ratio.

$$Daf=abyfrtgt(k)-abyfs(k) \tag{8}$$

A high pass filter A14 is a first order filter. A transfer function A14 (s) representing a characteristic of the high pass filter A14 is shown in a following Equation (9). In Equation (9), s is a Laplacean operator, and τ1 is a time constant. The time constant τ1 is identical to the time constant τ1 of the low pass filter A8. The high pass filter A14 substantially prohibits passage of low-frequency components having a frequency of no more than (1τ/1).

$$A14(s)=\{1-1/(1+\tau1\times s)\} \tag{9}$$

The high pass filter A14 inputs the air-fuel ratio deviation Daf, and in accordance with the characteristic formula shown in Equation (9), outputs a "main feedback control deviation DafHi", which is a "value obtained by subjecting the air-fuel ratio deviation Daf to high pass filter processing".

The main feedback amount updating unit A15 performs proportional processing on the main feedback control deviation DafHi serving as the output value of the high pass filter A14. More specifically, the main feedback amount updating unit A15 determines the main feedback amount KFmain (=1+GpHi×DafHi) by adding "1" to a value obtained by multiplying a proportional gain GpHi by the main feedback control deviation DafHi. The main feedback amount KFmain is used by the final fuel injection amount calculation unit A5 to determine the current final fuel injection amount Fi (k).

Note that the main feedback amount updating unit A15 may determine the main feedback amount KFmain by performing proportional-integral processing (PI processing) on the main feedback control deviation DafHi on the basis of a following Equation (10). In Equation (10), Gphi is a preset proportional gain (proportional constant) and Gihi is a preset integral gain (integral constant). SDafHi is a time integrated value of the main feedback control deviation DafHi. In this example, a coefficient KFB is "1". The coefficient KFB is preferably set to be variable in accordance with the engine rotation speed NE, the in-cylinder intake air amount Mc, and so on.

$$KF\text{main}=1+(Gphi\times DafHi+Gihi\times SDafHi)\times KFB \quad (10)$$

As is evident from the above description, the upstream side target air-fuel ratio setting unit A2, table conversion unit A10, target air-fuel ratio retardation unit A11, low pass filter A12, upstream side air-fuel ratio deviation calculation unit A13, high pass filter A14, and main feedback amount updating unit A15 together form a main feedback amount calculation unit (main feedback control unit).

[Calculation of Basic Correction Value]

The sub-feedback amount KSFB is calculated by having the PID controller A9 perform proportional-integral-derivative processing on the low pass filter-passed output deviation DVoxslow. However, variation in the air-fuel ratio of the engine appears as variation in the air-fuel ratio of the exhaust gas downstream of the upstream side catalyst 43 at a slight delay due to the effect of the oxygen storage function of the upstream side catalyst 43. Therefore, in a case where the magnitude of a steady state error resulting from a detection precision of the air flow meter 51 and an estimation precision of an air amount estimation model increases comparatively rapidly due to rapid variation in an operating region or the like, it is impossible to compensate for an excess or a deficiency in the fuel injection amount caused by the error immediately through the sub-feedback control alone.

In the main feedback control, which is not affected by the delay due to the oxygen storage function of the upstream side catalyst 43, on the other hand, the high pass filter processing performed by the high pass filter A14 realizes an equivalent function to derivative processing (D processing). Hence, in the main feedback control, where a value following passage through the high pass filter A14 is used as the input value of the main feedback amount updating unit A15, a main feedback amount KFmain including a substantive integral term could not be calculated even if the main feedback amount updating unit A15 were configured to determine the main feedback amount KFmain through integral processing. It is therefore impossible to compensate for a steady state error in the fuel injection amount due to the detection precision of the air flow meter and the estimation precision of the air amount estimation model with the main feedback control described above. As a result, emissions may increase temporarily following variation of the operating region and so on.

To compensate for the steady state error, the first control apparatus determines the basic correction value KF for correcting the pre-correction basic fuel injection amount Fbaseb. Further, as shown again in a following Equation (11), the first control apparatus determines the corrected basic fuel injection amount Fbase (k) using the basic correction value KF, and performs a further correction on the corrected basic fuel injection amount Fbase (k) using the main feedback amount KFmain.

$$Fi(k)=\{KF\times Fbaseb(k)\}\times KF\text{main} \quad (11)$$

The basic correction value KF is defined by a following Equation (12).

$$Fbaset(k-N)=KF\times Fbaseb(k-N) \quad (12)$$

In Equation (12), Fbaset is a true instructed injection amount required to obtain the target air-fuel ratio, and may also be defined as a basic fuel injection amount not including an error. Hereafter, Fbaset will be referred to as a "true basic fuel injection amount". The true basic fuel injection amount Fbaset (k−N) of Equation (12) is calculated using a following Equation (13).

$$Fbaset(k-N)=(abyfs(k)\times Fi(k-N))/abyfr(k-N) \quad (13)$$

Equation (13) will now be described further. The aforesaid N strokes are set at a number of strokes corresponding to the aforesaid "dead time". In other words, the present detected air-fuel ratio abyfs (k) is an air-fuel ratio generated by fuel injected on the basis of the final fuel injection amount Fi (k−N). Accordingly, the numerator abyfs(k)×Fi(k−N) on the right side of Equation (13) expresses the in-cylinder air amount upon determination of the final fuel injection amount Fi(k−N). Hence, as shown in Equation (13), the true basic fuel injection amount Fbaset(k−N) is calculated by dividing the in-cylinder air amount (abyfs (k)×Fi (k−N)) at the point where the final fuel injection amount Fi(k−N) is determined by the target air-fuel ratio abyfr (k−N) at the point where the final fuel injection amount Fi (k−N) is determined.

Meanwhile, the pre-correction basic fuel injection amount Fbaseb (k) used in Equation (12) is determined on the basis of a following Equation (14).

$$Fbaseb(k)=Mc(k/abyfr(k) \quad (14)$$

Hence, the first control apparatus determines the basic correction value KF on the basis of a following Equation (15), which is obtained from the Equations (12) to (14), associates the determined basic correction value KF with the operating region at the time of calculation of the basic correction value KF, and stores the result in a memory.

$$KF=Fbaset(k-N)/Fbaseb(k-N)=\{abyfs(k)\times Fi(k-N)/abyfr(k-N)\}/\{Mc(k-N)/abyfr(k-N)\} \quad (15)$$

Figure 6:
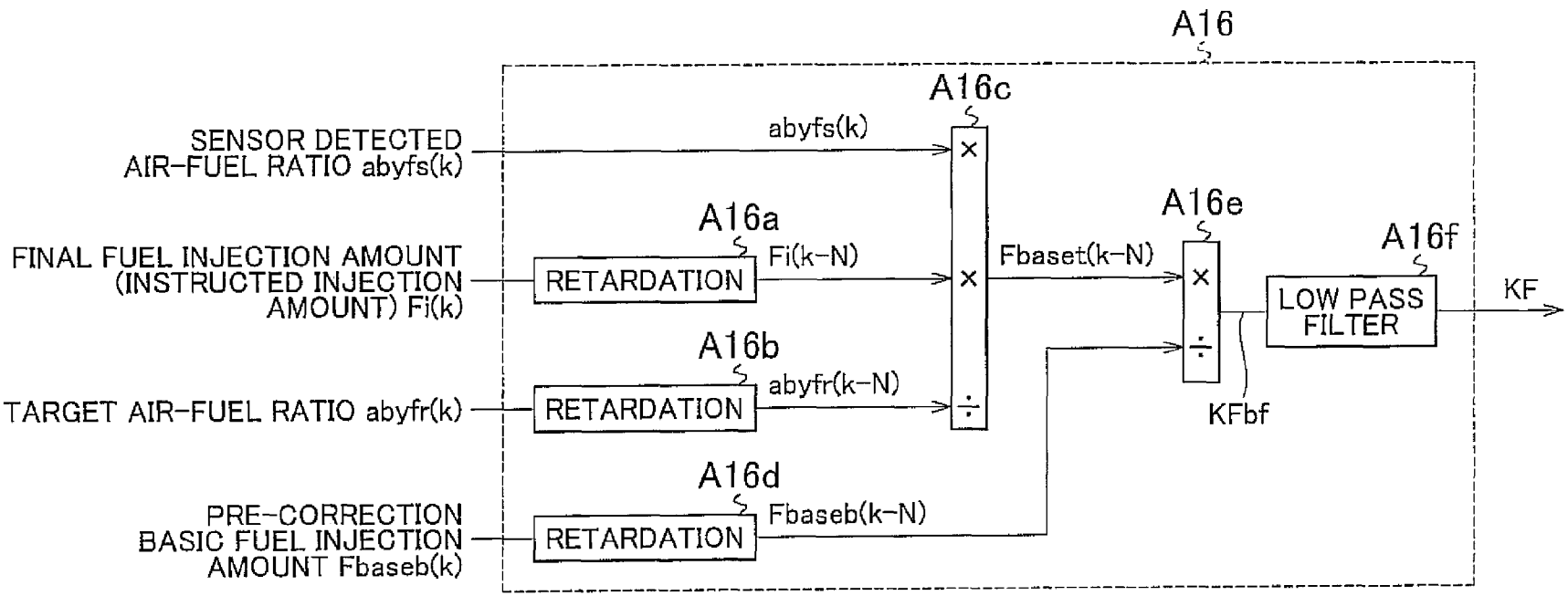
FIG. 6 is a functional block diagram of a basic correction value calculation unit shown in FIG. 5.

The basic correction value KF is calculated by the basic correction value calculation unit A16, which is configured in accordance with principles expressed by Equation (15). An actual process of calculating the basic correction value KF will now be described with reference to FIG. 6, which is a functional block diagram of the basic correction value calculation unit A16. The basic correction value calculation unit A16 is configured to include a final fuel injection amount retardation unit A16*a*, a target air-fuel ratio retardation unit A16*b*, a basic fuel injection amount calculation unit A16*c*, a pre-correction basic fuel injection amount retardation unit A16*d*, a pre-filter basic correction value calculation unit A16*e*, a low pass filter A16*f*, and so on.

The final fuel injection amount retardation unit A16*a* determines the final fuel injection amount Fi (k−N) N strokes before the present by retarding the current final fuel injection amount Fi (k). In actuality, the final fuel injection amount retardation unit A16*a* reads the final fuel injection amount Fi (k−N) from the RAM.

The target air-fuel ratio retardation unit A16*b* determines the target air-fuel ratio abyfr (k−N) N strokes before the present by retarding the current target air-fuel ratio abyfr (k).

In actuality, the target air-fuel ratio retardation unit A16*b* reads the target air-fuel ratio abyfr (k−N) from the RAM.

The true basic fuel injection amount calculation unit A16*c* determines the true basic fuel injection amount Fbaset (k−N) N strokes before the present in accordance with (Fbaset (k−N)= (abyfs (k)×Fi (k−N)/abyfr (k−N)) of Equation (13).

The pre-correction basic fuel injection amount retardation unit A16*d* determines the pre-correction basic fuel injection amount Fbaseb (k−N) N strokes before the present by retarding the current pre-correction basic fuel injection amount Fbaseb (k). In actuality, the pre-correction basic fuel injection amount retardation unit Al6*d* reads the pre-correction basic fuel injection amount Fbaseb (k−N) from the RAM.

The pre-filter basic correction value calculation unit A16*e* calculates a pre-filter basic correction value KFbf by dividing the true basic fuel injection amount Fbaset (k−N) by the pre-correction basic fuel injection amount Fbaseb (k−N) in accordance with an equation (KFbf=Fbaset (k−N)/Fbaseb (k−N)), which is based on Equation (15).

The low pass filter A16*f* calculates the basic correction value KF by implementing low pass filter processing on the pre-filter basic correction value KFbf. This low pass filter processing is performed to stabilize the basic correction value KF (i.e. to remove a noise component superimposed on the pre-filter basic correction value KFbf). The basic correction value KF thus determined is stored in the RAM and the backup RAM in association with the operating region to which the operating condition belonged N strokes before the present.

Hence, the basic correction value calculation unit A16 updates the basic correction value KF whenever the time to calculate the final fuel injection amount Fi (k) arrives using the final fuel injection amount retardation unit A16*a*, target air-fuel ratio retardation unit A16*b*, the basic fuel injection amount calculation A16*c*, pre-correction basic fuel injection amount retardation unit A16*d*, pre-filter basic correction value calculation unit A16*e*, low pass filter A16*f*, and so on. The basic correction value calculation unit A16 then reads the basic correction value KF stored in the operating region to which the operating condition of the engine 10 belonged at the time of calculation of the final fuel injection amount Fi (k) from the backup RAM, and provides the corrected basic fuel injection amount calculation unit A4 with the read basic correction value KF. As a result, the steady state error in the fuel injection amount (the pre-correction basic fuel injection amount) is compensated quickly. This ends the brief description of the main feedback control and sub-feedback control performed by the first control apparatus.

(Actual Operation)

Next, an actual operation of the first control apparatus will be described. For convenience, it is assumed in the following description that "MapX (a1, a2, . . . )" represents a lookup table for determining a value X having a1, a2, . . . as a parameter. Further, when values of the parameters are sensor detection values, current values are applied to the parameter values.

[Calculation of Final Fuel Injection Amount Fi (k)]

Figure 7:
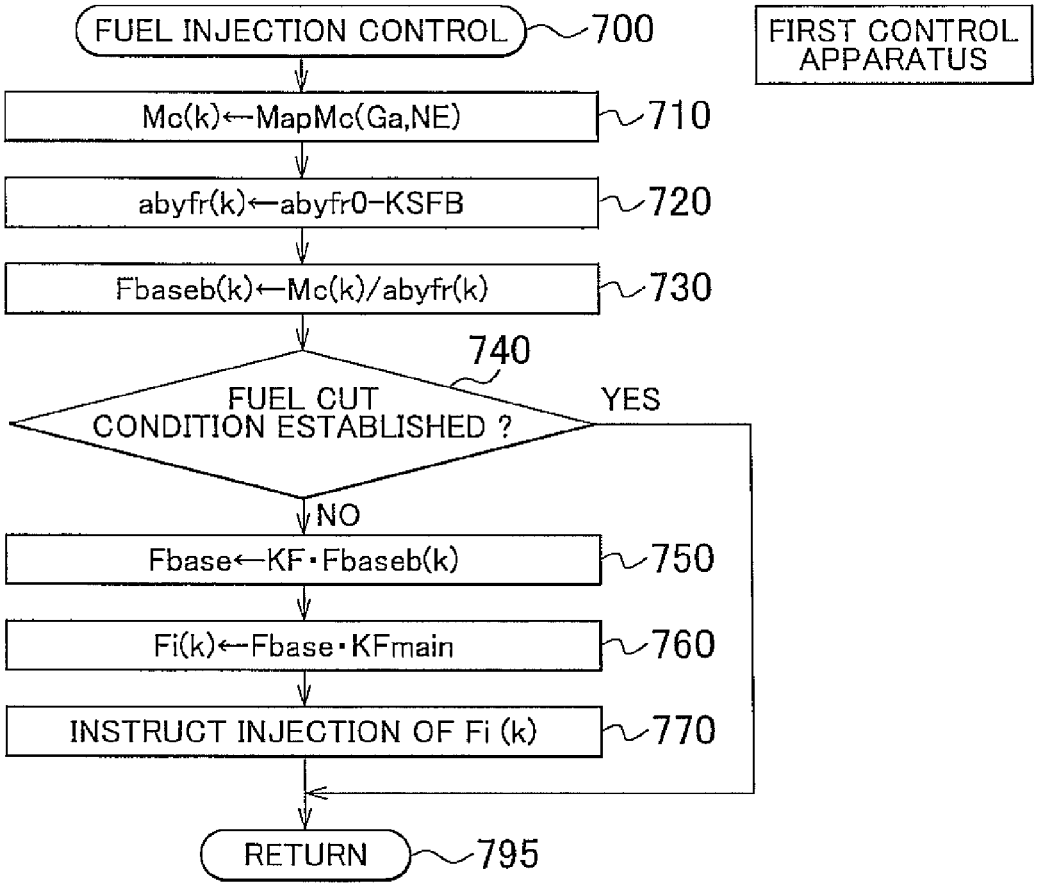
FIG. 7 is a flowchart showing a routine executed by a central processing unit (CPU) of the first control apparatus.

The CPU executes a routine for calculating the final fuel injection amount Fi and issuing an injection instruction, shown on a flowchart in FIG. 7, repeatedly every time the crank angle of each cylinder reaches a predetermined crank angle before intake top dead center (BTDC 90° CA, for example). Accordingly, when the crank angle of an arbitrary cylinder reaches the predetermined crank angle, the CPU starts the processing from Step 700, performs the processing of Step 710 to Step 730, described below, in sequence, and then advances to Step 740.

Step 710: The CPU estimates/determines the current in-cylinder intake air amount Mc (k) suctioned into the cylinder currently passing through the intake stroke (also referred to as a "fuel injection cylinder" hereafter) on the basis of a table MapMc (Ga, NE). The in-cylinder intake air amount Mc (k) may be calculated using an air amount estimation model (a model constructed in accordance with physical laws pertaining to the behavior of air in an intake passage).

Step 720: The CPU determines the target air-fuel ratio abyfr (k) on the basis of a following Equation (16). The target air-fuel ratio abyfr (k) is stored in the RAM in association with the intake stroke of each cylinder. In Equation (16), abyfr0 is a predetermined reference air-fuel ratio, which is set at the stoichiometric air-fuel ratio stoich here. Hence, the target air-fuel ratio abyfr (k) decreases as the sub-feedback amount KSFB increases. Note that the target air-fuel ratio abyfr (k) may also be corrected on the basis of the operating conditions of the engine 10, such as the intake air amount Ga and/or the engine rotation speed NE.

$$abyfr(k)=abyfr0-KSFB \tag{16}$$

Step 730: The CPU calculates the pre-correction basic fuel injection amount Fbaseb (k) by dividing the in-cylinder intake air amount Mc (k) by the target air-fuel ratio abyfr (k). The pre-correction basic fuel injection amount Fbaseb (k) is stored in the RAM in association with the intake stroke of each cylinder.

Next, the CPU advances to Step 740, where the CPU determines whether or not the current operating condition satisfies a fuel cut condition. When the fuel cut condition is established, the CPU determines "Yes" in step 740 and advances directly to a step 795, where the routine is temporarily terminated. In this case, Step 770 for issuing a fuel injection instruction is not executed, and therefore fuel injection is stopped (a fuel cut operation is executed).

When the fuel cut condition is not established in the determination of Step 740, on the other hand, the CPU determines "No" in Step 740, performs the processing of Step 750 to Step 770, described below, in sequence, and then advances to Step 795, where the routine is temporarily terminated.

Step 750: The CPU reads the basic correction value KF stored in the operating region to which the operating condition belongs at present, from among basic correction values KF calculated in a routine to be described below and stored in the RAM for each operating region. Note that when a main feedback control condition is not established, a value "1" is set as the basic correction value KF regardless of the operating condition. Further, the CPU sets a value obtained by multiplying the read basic correction value KF by the pre-correction basic fuel injection amount Fbaseb (k) as the corrected basic fuel injection amount Fbase.

Step 760: The CPU determines the current final fuel injection amount Fi (k) by multiplying the main feedback amount KFmain, which is determined in a routine to be described below, by the corrected basic fuel injection amount Fbase in accordance with Equation (2) and Equation (11).

Step 770: The CPU issues an injection instruction to the fuel injection valve 33 of the fuel injection cylinder so that the fuel injection valve 33 injects fuel in the final fuel injection amount Fi (k).

In the routine described above, the pre-correction basic fuel injection amount Fbaseb (k) is obtained on the basis of the target air-fuel ratio abyfr (k) and the current in-cylinder intake air amount Mc (k), and the corrected basic fuel injection amount Fbase is obtained from the pre-correction basic fuel injection amount Fbaseb (k) and the basic correction value KF. Further, the final fuel injection amount Fi (k) is determined by correcting the corrected basic fuel injection amount Fbase using the main feedback amount KFmain, whereupon an instruction is issued to the fuel injection valve 33 of the fuel injection cylinder to inject fuel in the final fuel injection amount Fi (k).

[Calculation of Main Feedback Amount]

Figure 8:
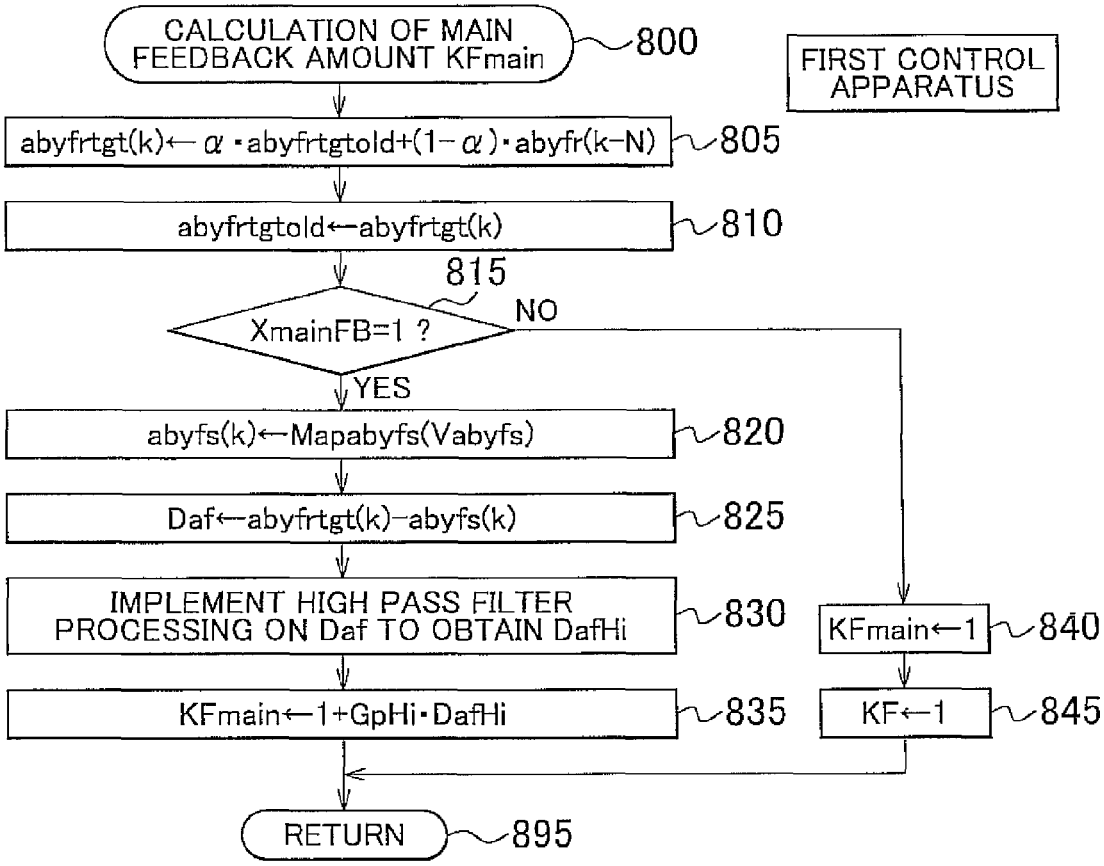
FIG. 8 is a flowchart showing a routine executed by the CPU of the first control apparatus.

The CPU executes a routine shown on a flowchart in FIG. 8 repeatedly every time an execution period Δt1 (constant) elapses. Accordingly, the CPU starts the processing from Step 800 at a predetermined timing, executes the processing of Step 805 and Step 810, described below, in sequence, and then advances to Step 815. Note that the execution period Δt1 is set at a shorter period than a generation interval between two consecutive injection instructions when the engine rotation speed NE is at a maximum envisaged engine rotation speed, for example.

Step 805: The CPU determines the main feedback control target air-fuel ratio abyfrtgt (k) in accordance with a simple low pass filter equation (abyfrtgt (k)=α×abyfrtgtold+(1−α)×abyfr (k−N)) illustrated in Step 805. Here, α is a constant larger than zero and smaller than one, which is set in accordance with the time constant τ of the low pass filter A12. abyfrtgtold is a "main feedback control target air-fuel ratio abyfrtgt calculated in Step 810 of the previous routine". abyfrtgtold will be referred to as a previous main feedback control target air-fuel ratio. abyfr (k−N) is the actual upstream side target air-fuel ratio N strokes before the present.

Step 810: The CPU stores the main feedback control target air-fuel ratio abyfrtgt (k) calculated in Step 805 as the previous main feedback control target air-fuel ratio abyfrtgtold to be used during execution of the next routine.

Next, the CPU advances to Step 815, where the CPU determines whether or not a value of a main feedback control condition establishment flag XmainFB is "1". The value of the main feedback control condition establishment flag XmainFB is set at "1" when the main feedback control condition is established and set at "0" when the main feedback control condition is not established.

The main feedback control condition is established when all of the following conditions, for example, are established.

The upstream side air-fuel ratio sensor 56 is active.

The fuel cut condition is not established (the engine 10 is not in the fuel cut operating condition).

When the value of the main feedback control condition establishment flag XmainFB is at "1" at this time, the CPU performs the processing of Step 820 to Step 835, described below, in sequence and then advances to Step 895, where the routine is temporarily terminated.

Step 820: The CPU determines the present detected air-fuel ratio abyfs (k) by converting the present output value Vabyfs of the upstream side air-fuel ratio sensor 56 on the basis of the table Mapabyfs (Vabyfs) shown in FIG. 2.

Step 825: The CPU determines the air-fuel ratio deviation Daf by subtracting the current detected air-fuel ratio abyfs (k) from the main feedback control target air-fuel ratio abyfrtgt (k) in accordance with an equation illustrated in Step 825, i.e. Equation (8).

Step 830: The CPU obtains the main feedback control deviation DafHi by implementing high pass filter processing having the characteristic illustrated in Equation (9) on the air-fuel ratio deviation Daf.

Step 835: The CPU determines the main feedback amount KFmain by adding a value "1" to a product of the main feedback control deviation DafHi and the proportional gain GpHi.

When the value of the main feedback control condition establishment flag XmainFB is at "0", on the other hand, the CPU performs the processing of Step 840 and Step 845, described below, in sequence following Step 815 and then advances to Step 895, where the routine is temporarily terminated.

Step 840: The CPU sets the main feedback amount KFmain at "1".

Step 845: The CPU sets the basic correction value KF at "1".

Hence, when the main feedback control condition is not established (XmainFB=0), updating of the main feedback amount KFmain is stopped and the value of the main feedback amount KFmain is set at "1", whereby the main feedback control is stopped (reflection of the main feedback amount KFmain in the final fuel injection amount Fi is stopped). Further, when the main feedback control condition is not established (XmainFB=0), the value of the basic correction value KF is set at "1", whereby reflection of the basic correction value KF in the final fuel injection amount Fi is stopped.

[Calculation and Storage of Basic Correction Value]

Figure 9:
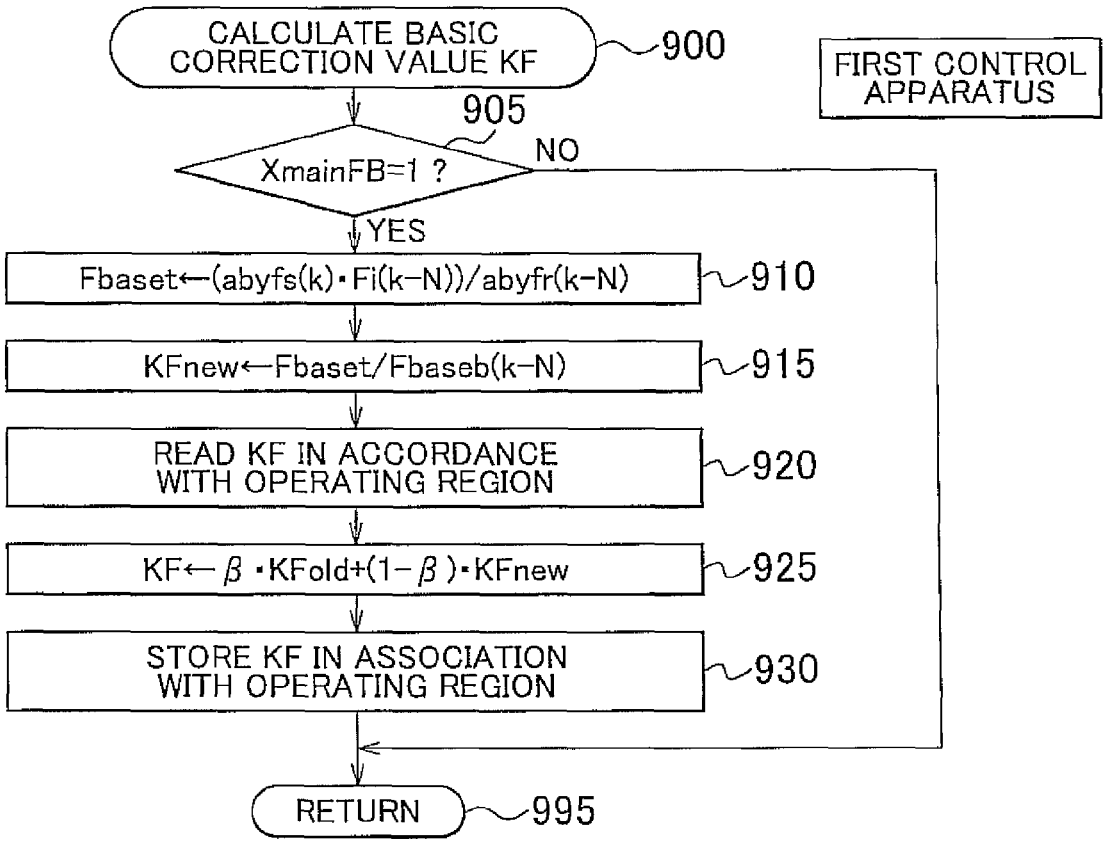
FIG. 9 is a flowchart showing a routine executed by the CPU of the first control apparatus.

The CPU executes a routine shown on a flowchart in FIG. 9 repeatedly prior to execution of the routine shown in FIG. 7. Accordingly, the CPU starts the processing from Step 900 at a predetermined timing and advances to Step 905, where the CPU determines whether or not the value of the main feedback control condition establishment flag XmainFB is at "1". When the value of the main feedback control condition establishment flag XmainFB is at "1" at this time, the CPU performs the processing of Step 910 to Step 930, described below, in sequence and then advances to Step 995, where the routine is temporarily terminated.

Step 910: The CPU calculates the "true basic fuel injection amount Fbaset N strokes before the present" in accordance with an equation illustrated in Step 910, i.e. Equation (13). Note that the final fuel injection amount Fi (k−N) N strokes before the present and the target air-fuel ratio abyfr (k−N) N strokes before the present are both read from the RAM.

Step 915: The CPU calculates a current value KFnew (the pre-filter basic correction value KFbf) serving as a basis of the basic correction value KF by dividing the true basic fuel injection amount Fbaset N strokes before the present by the pre-correction basic fuel injection amount Fbaseb (k−N) N strokes before the present on the basis of an equation illustrated in Step 915, i.e. Equation (15). Note that the pre-correction basic fuel injection amount Fbaseb (k−N) N strokes before the present is read from the RAM.

Step 920: The CPU reads the basic correction value KF stored in the backup RAM in association with the operating region to which the operating condition of the engine 10 belonged N strokes before the present from the backup RAM. The read basic correction value KF serves as a past basic correction value KFold.

Step 925: The CPU calculates a new basic correction value KF (a final basic correction value KF) in accordance with a simple low pass filter equation (KF=β×KFold+(1−β)×KFnew) illustrated in Step 925. Here, β is a constant larger than zero and smaller than one.

Step 930: The CPU stores the basic correction value KF determined in Step 925 in a storage area of the backup RAM corresponding to the operating region to which the operating condition of the engine 10 belonged N strokes before the present. The basic correction value KF is thus updated and stored.

When the value of the main feedback control condition establishment flag XmainFB is at "0", on the other hand, the CPU determines "No" in Step 905 and advances immediately to Step 995, where the routine is temporarily terminated. In this case, the processing for updating the basic correction value KF and storing the updated basic correction value KF in the backup RAM is not executed.

Note that the value of the basic correction value KFnew may be employed as is as the new basic correction value KF. In this case, Step 920 may be omitted and the constant β of Step 925 may be set at "0".

[Calculation of Sub-Feedback Amount]

The CPU executes a routine shown on a flowchart in FIG. 10 repeatedly at predetermined time intervals. Accordingly, the CPU starts the processing from Step 1000 at a predetermined timing and advances to Step 1005, where the CPU determines whether or not a sub-feedback control condition is established. The sub-feedback control condition is established when it is determined that the main feedback control condition is established and the downstream side air-fuel ratio sensor 57 is active.

It is assumed in the following description that the sub-feedback control condition is established. In this case, the CPU performs the processing of Step 1010 to Step 1040, described below, in sequence and then advances to Step 1045.

Step 1010: The CPU determines the output deviation DVoxs by subtracting the present output value Voxs of the downstream side air-fuel ratio sensor 57 from the downstream side target value Voxsref in accordance with an equation illustrated in Step 1010, i.e. Equation (3).

Step 1015: The CPU calculates the low pass filter-passed output deviation DVoxslow by implementing low pass filter processing having the characteristic illustrated in Equation (4) on the output deviation DVoxs.

Step 1020: The CPU determines the derivative value DDVoxslow of the low pass filter-passed output deviation DVoxslow on the basis of a following Equation (17). In Equation (17), DVoxslowold is a "low pass filter-passed output deviation DVoxslow set (updated) in Step 1040, to be described below," during execution of the previous routine. Further, At is a period extending from the previous execution to the current execution of the routine.

$$DD\text{Voxslow}=(D\text{Voxslow}-D\text{Voxslowold})/\Delta t \quad (17)$$

Step 1025: The CPU reads the "proportional gain Kp determined separately in a routine shown in FIG. 15, to be described below," and the "adjustment gain K determined separately in a routine shown in FIG. 16, to be described below".

The proportional gain Kp is set at a smaller value as a possibility of convergence of the sub-FB learned value KSFBg (i.e. the degree of convergence of the sub-FB learned value KSFBg) is determined to be higher (in other words, as the value of the status increases).

The adjustment gain K is set at a smaller value as the possibility of convergence of the sub-FB learned value KSFBg (i.e. the degree of convergence of the sub-FB learned value KSFBg) is determined to be higher (in other words, as the value of the status increases) in a case where the maximum oxygen storage amount Cmax is constant. Further, when the value of the status, to be described below, is "a certain value", the adjustment gain K is set at a smaller value as the maximum oxygen storage amount Cmax increases (in other words, as the degree of deterioration of the catalyst decreases).

Step 1030: The CPU determines the time integrated value SDVoxslow in accordance with an equation illustrated in Step 1030, i.e. Equation (5).

Step 1035: The CPU determines the sub-feedback amount KSFB in accordance with an equation illustrated in Step 1035, i.e. Equation (6).

Step 1040: The CPU stores the low pass filter-passed output deviation DVoxslow determined in Step 1010 as the previous value DVoxslowold of the low pass filter-passed output deviation DVoxslow.

Next, the CPU advances to Step 1045, where the CPU determines whether or not the learning interval time Tth has elapsed from an update time of the previous sub-FB learned value KSFBg. When, at this time, the learning interval time Tth has not elapsed from the update time of the previous sub-FB learned value KSFBg, the CPU determines "No" in Step 1045 and advances directly to Step 1095, where the routine is temporarily terminated.

When the learning interval time Tth has elapsed from the update time of the previous sub-FB learned value KSFBg at the point where the CPU executes the processing of Step 1045, on the other hand, the CPU performs the processing of Step 1055 to Step 1065, described below, in sequence and then advances to Step 1095, where the routine is temporarily terminated.

Step 1055: The CPU updates the sub-FB learned value KSFBg by adding a product of the integral gain Ki and the time integrated value SDVoxslow (in other words, the integral term Ki×SDVoxslow) to "the sub-FB learned value KSFBg at that time (i.e. pre-update)", and stores the updated sub-FB learned value KSFBg in the backup RAM. Thus, as the sub-FB learned value KSFBg, the CPU extracts an "integral term Ki×SDVoxslow (a value that is commensurate with the time integrated value SDVoxslow) corresponding to a steady state component of the sub-feedback amount KSFB" at a point where a longer period than the update period of the sub-feedback amount KSFB has elapsed.

Step 1060: The CPU updates a variation center (a weighted average) Vc of the past value of the sub-FB learned value KSFBg in accordance with a following Equation (18). γ is a constant larger than zero and smaller than one. Vc (n) is a post-update center value Vc, and Vc (n−1) is a pre-update center value Vc.

$$Vc(n)=\gamma\times Vc(n-1)+(1-\gamma)\times KSFBg \quad (18)$$

Step 1065: The CPU sets the time integrated value SDVoxslow at "0" in accordance with a following Equation (19). The CPU then advances to Step 1095, where the routine is temporarily terminated.

$$SD\text{Voxslow}(n)=0 \quad (19)$$

When it is determined in the determination of Step 1005 that the sub-feedback control condition is not established, on the other hand, the CPU determines "No" in Step 1005 and advances to Step 1070, where the sub-FB learned value KSFBg is substituted for the sub-feedback amount KSFB. Next, the CPU sets a "value (KSFBg/Ki) obtained by dividing the sub-FB learned value KSFBg by the integral gain Ki" as the integral value SDVoxslow in Step 1075, and then advances to Step 1095, where the routine is temporarily terminated.

[Initial Setting of Status]

As described above, the proportional gain Kp and the adjustment gain K are determined on the basis of the "status", which expresses the "degree of convergence (a degree of learning advancement) of the sub-FB learned value KSFBg".

In this respect, an operation performed by the CPU to set the "status" will be described below. The status N (N=0, 1, 2) is defined as described above.

For convenience, it is assumed in the following description that the present corresponds to a point immediately after startup of the internal combustion engine 10 and that the "battery for supplying power to the electric control device 70" was replaced prior to engine startup. The CPU executes a "status initial setting routine" shown on a flowchart in FIG. 11 at predetermined time intervals from startup of the internal combustion engine 10 onward.

Hence, when a predetermined timing arrives from startup of the internal combustion engine 10 onward, the CPU starts the processing from Step 1100 and then advances to Step 1110, where the CPU determines "whether or not the present corresponds to a point immediately after startup of the internal combustion engine 10".

In accordance with the aforementioned assumption, the present corresponds to a point immediately after startup of the internal combustion engine 10. Therefore, the CPU determines "Yes" in Step 1110, and advances to Step 1120, where the CPU determines whether or not the "battery for supplying power to the electric control device 70" has been replaced. In accordance with the aforementioned assumption, the battery was replaced beforehand. Therefore, the CPU determines "Yes" in Step 1120 and advances to Step 1130, where the status is set/updated to "0". The value of the "status" is stored/updated in the backup RAM following every update thereof.

Next, the CPU advances to Step 1140, where a counter CI is cleared (set at "0"), and then advances to Step 1150, where the following processing is performed. The CPU sets the "sub-FB learned value KSFBg stored in the backup RAM" at "0 (initial value, default value)". The CPU also sets the time integrated value SDVoxslow at "0 (initial value, default value)". The CPU also sets the center value Vc at "0 (initial value, default value)". The CPU also sets the determination reference value Vkijun at "0 (initial value, default value)". The CPU then advances to Step 1195, where the routine is temporarily terminated.

When the CPU determines that the battery has not been replaced after advancing to Step 1120, the CPU determines "No" in Step 1120 and advances to Step 1160, where the status stored in the backup RAM is read. Next, the CPU reads the "center value Vc calculated in Step 1060 of FIG. 10" and the "determination reference value Vkijun" from the backup RAM in Step 1170. The determination reference value Vkijun is a value that serves as a reference of a threshold for determining the "status", and is updated in Step 1340 of FIG. 13, to be described below.

Thereafter, the CPU determines "No" in Step 1110 and advances directly to Step 1195, where the routine is temporarily terminated.

[Status Determination 1 (First Status Determination)]

Figure 12:
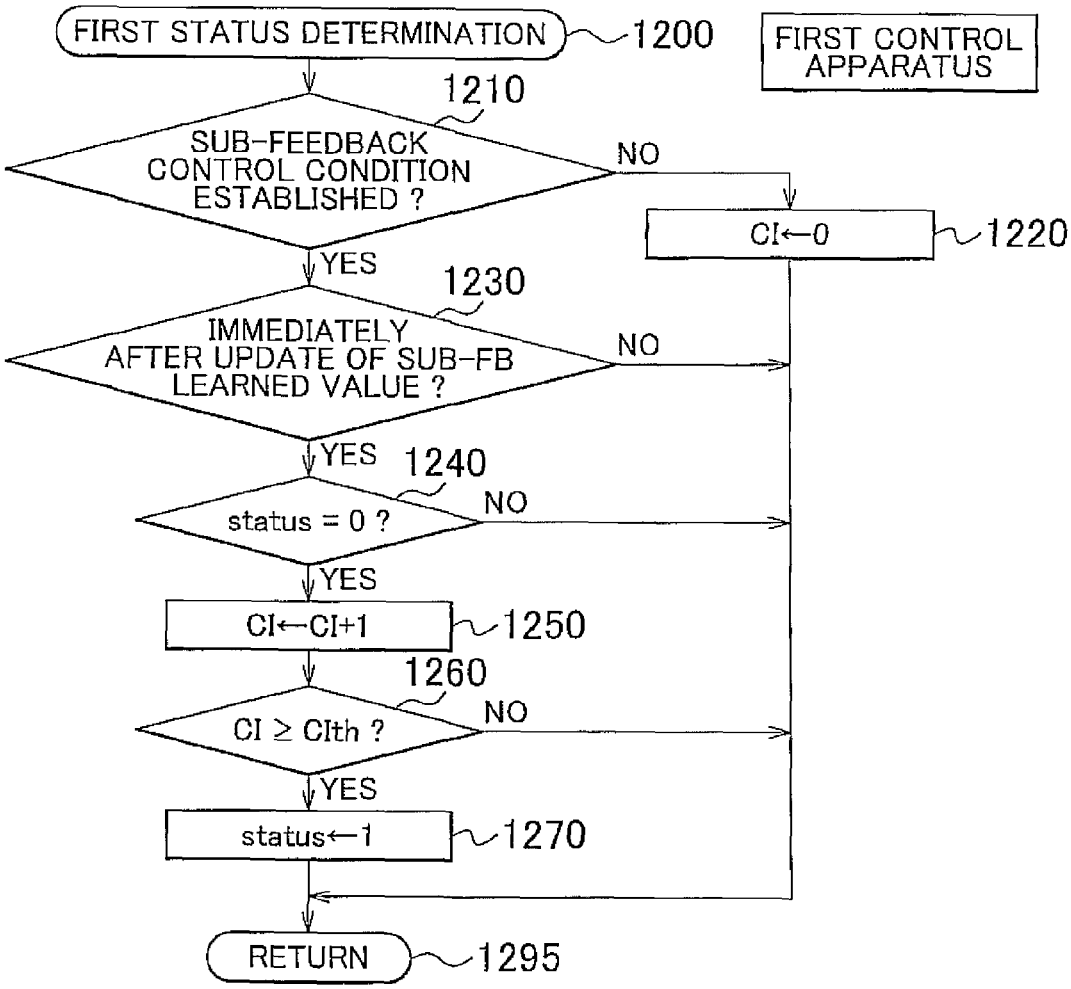
FIG. 12 is a flowchart showing a routine executed by the CPU of the first control apparatus.

To perform a status determination, the CPU executes a "first status determination routine" shown on a flowchart in FIG. 12 at predetermined time intervals. When a predetermined timing arrives, the CPU starts the processing from Step 1200 in FIG. 12, and then advances to Step 1210, where the CPU determines whether or not the sub-feedback control condition is established.

When the sub-feedback control condition is not established at this time, the CPU determines "No" in Step 1210 and advances to Step 1220. In Step 1220, the CPU sets the counter CI at "0", and then advances directly to Step 1295, where the routine is temporarily terminated. Note that the counter CI is set at "0" in an initial routine, not shown in the drawings, which is executed when the ignition key switch, not shown in the drawings, of the vehicle installed with the engine 10 is switched from the OFF position to the ON position.

When the CPU determines that the sub-feedback control condition is established after advancing to Step 1210, on the other hand, the CPU determines "Yes" in Step 1210 and advances to Step 1230, where the CPU determines whether or not the present corresponds to "a point immediately after updating of the sub-FB learned value KSFBg" (i.e. a point immediately after the processing of Step 1055 in FIG. 10).

When the present does not correspond to "a point immediately after updating of the sub-FB learned value KSFBg" at this time, the CPU determines "No" in Step 1230 and advances directly to Step 1295, where the routine is temporarily terminated.

When the present corresponds to "a point immediately after updating of the sub-FB learned value KSFBg" after the CPU advances to Step 1230, on the other hand, the CPU determines "Yes" in Step 1230 and advances to Step 1240, where the CPU determines whether or not the status is "0" (the status corresponds to status 0). When the status is not "0" at this time, the CPU determines "No" in Step 1240 and advances directly to Step 1295, where the routine is temporarily terminated.

When the status is "0" after the CPU advances to Step 1240, on the other hand, the CPU determines "Yes" in Step 1240 and advances to Step 1250, where the counter CI is increased by "1". Next, the CPU advances to Step 1260, where the CPU determines whether or not the counter CI equals or exceeds an update threshold CIth. When the counter CI is lower than the update threshold CIth at this time, the CPU determines "No" in Step 1260 and advances directly to Step 1295, where the routine is temporarily terminated.

When the counter CI equals or exceeds the update threshold CIth after the CPU advances to Step 1260, on the other hand, the CPU determines "Yes" in Step 1260 and advances to Step 1270, where the status is set/updated to "1" (the status is set at status 1).

Hence, when the status is "0" and the sub-FB learned value KSFBg is updated a number of times equaling or exceeding the update threshold CIth, the status is modified to "1". The purpose of this processing is to make it possible to determine that the sub-FB learned value KSFBg has approached the convergence value to a certain extent when the sub-FB learned value KSFBg is updated a number of times equaling or exceeding the update threshold CIth. Note that Step 1220 may be omitted. Further, the counter CI may be set at "0" after executing Step 1270. The entire routine of FIG. 12 may also be omitted.

[Status Determination 2 (Second Status Determination)]

Figure 13:
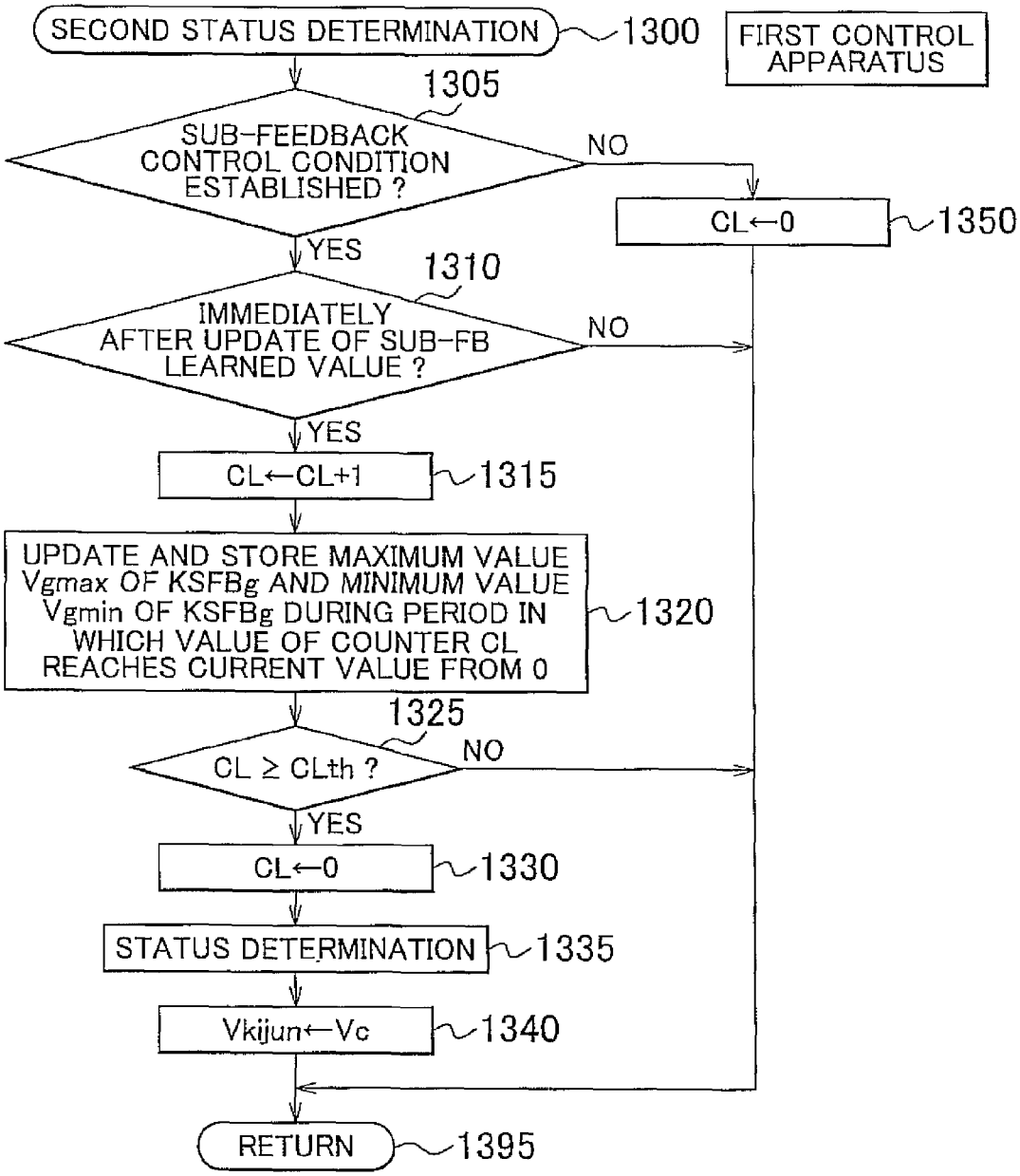
FIG. 13 is a flowchart showing a routine executed by the CPU of the first control apparatus.

To perform this status determination, the CPU executes a "second status determination routine" shown on a flowchart in FIG. 13 at predetermined time intervals. It is assumed in the following description that the status has been set at "0" in Step 1130 of FIG. 11 due to replacement of the "battery for supplying power to the electric control device 70" prior to startup of the engine 10, and that the sub-FB learned value KSFBg has been set at "0" in Step 1150. It is also assumed that the present corresponds to a point immediately after startup of the engine 10.

When a predetermined timing arrives, the CPU starts the processing from Step 1300 in FIG. 13, and then advances to Step 1305, where the CPU determines whether or not the sub-feedback control condition is established. The sub-feedback control condition is typically not established immediately after startup of the engine 10. Therefore, the CPU determines "No" in Step 1305 and advances to Step 1350, where a counter CL is set at "0". Note that the counter CL is set at "0"

in the aforementioned initial routine. The CPU then advances directly to Step 1395, where the routine is temporarily terminated.

In this case, the CPU advances from Step 1005 to Step 1070 in FIG. 10, and therefore the processing of Step 1055 is not executed. Accordingly, the sub-FB learned value KSFBg is maintained at "0".

When the engine 10 continues to operate thereafter, the sub-feedback control condition is established. Accordingly, the sub-feedback amount KSFB is updated by the routine in FIG. 10.

When the CPU advances to Step 1305 of FIG. 13 in this condition, the CPU determines "Yes" in Step 1305, and advances to Step 1310. In Step 1310, the CPU determines whether or not the present corresponds to a point immediately after updating of the sub-FB learned value KSFBg. When the present does not correspond to a point immediately after updating of the sub-FB learned value KSFBg at this time, the CPU determines "No" in Step 1310 and advances directly to Step 1395, where the routine is temporarily terminated.

When the present corresponds to a point immediately after updating of the sub-FB learned value KSFBg (a point immediately after execution of the processing of Step 1055 in FIG. 10), on the other hand, the CPU determines "Yes" in Step 1310 and advances to Step 1315, where the counter CL is increased by "1". Next, the CPU advances to Step 1320, where a maximum value Vgmax and a minimum value Vgmin of the sub-FB learned value KSFBg are updated. The maximum value Vgmax and the minimum value Vgmin of the sub-FB learned value KSFBg are, respectively, a maximum value and a minimum value of the sub-FB learned value KSFBg within a period extending from "0" on the counter CL to a threshold CLth used in a following step 1325 (a predetermined period for determining the degree of convergence of the sub-FB learned value KSFBg, i.e. a condition determination period).

Next, the CPU advances to Step 1325, where the CPU determines whether or not the counter CL equals or exceeds the threshold CLth. When the counter CL is lower than the threshold CLth at this time, the CPU determines "No" in Step 1325 and advances directly to Step 1395, where the routine is temporarily terminated.

Then, after time passes, the processing of Step 1315 is executed every time the sub-FB learned value KSFBg is updated (i.e. every time the learning interval time Tth elapses). Accordingly, the counter CL reaches the threshold CLth. When the CPU advances to Step 1325 at this time, the CPU determines "Yes" in Step 1325 and then advances to Step 1330, where the counter CL is set at "0".

Figure 14:
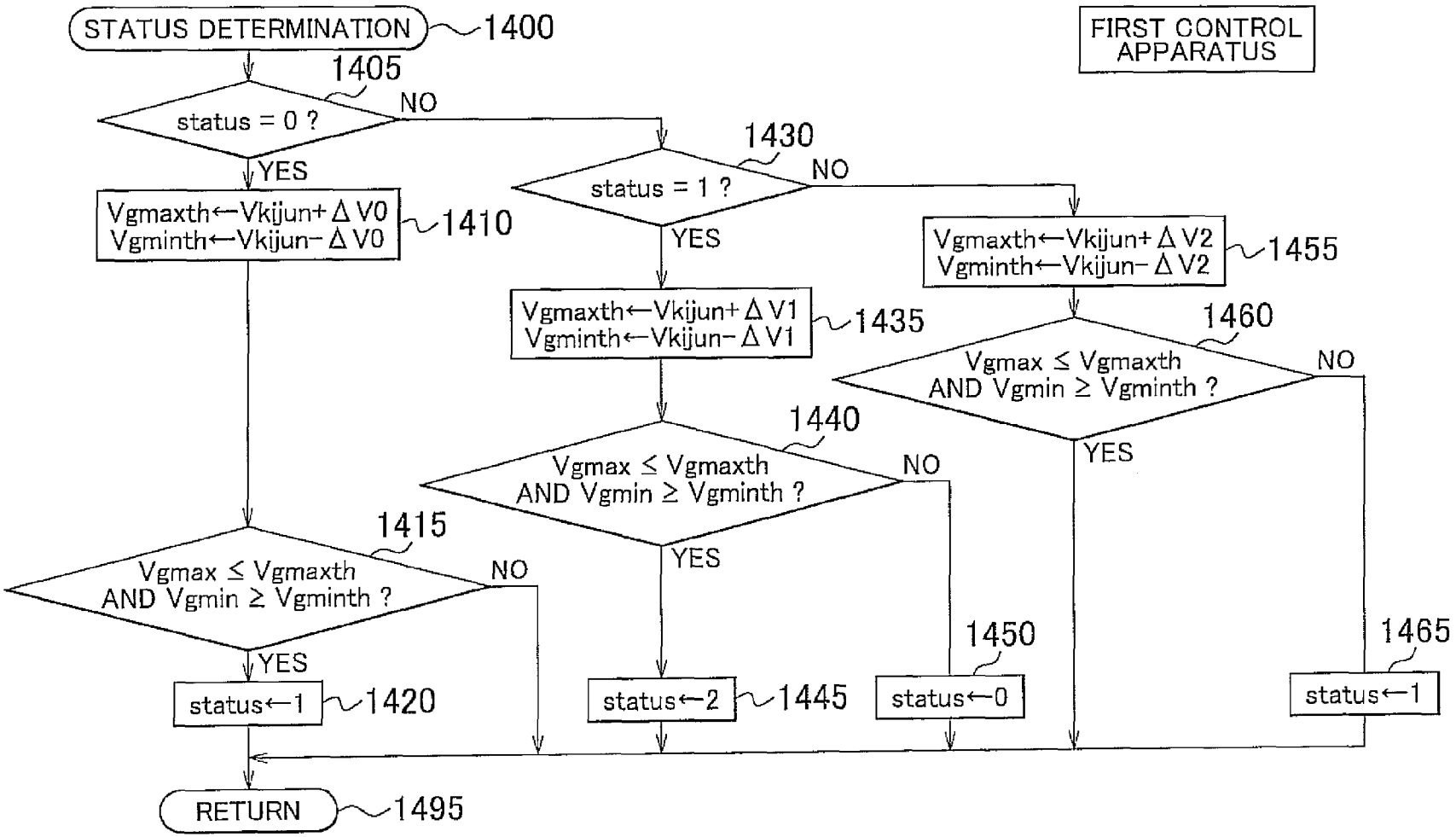
FIG. 14 is a flowchart showing a routine executed by the CPU of the first control apparatus.

Next, the CPU advances to Step 1335, where a routine shown in FIG. 14 is executed. More specifically, the CPU starts the processing from Step 1400 in FIG. 14 and then advances to Step 1405, where the CPU determines whether or not the status is "0". In accordance with the aforesaid assumption, the status is "0", and therefore the CPU determines "Yes" in Step 1405 and advances to Step 1410, where the CPU sets a value (Vkijun+ΔV0) obtained by adding a "first value ΔV0, which is a predetermined positive specific value," to the determination reference value Vkijun as the upper limit value (a large side threshold) Vgmaxth. Further, the CPU sets a value (Vkijun−ΔV0) obtained by subtracting the "first value ΔV0" from the determination reference value Vkijun as the lower limit value (a small side threshold) Vgminth. Note that the value of the determination reference value Vkijun at this time is "0".

Next, the CPU advances to Step 1415, where the CPU determines whether or not the maximum value Vgmax obtained in Step 1320 of FIG. 13 is no greater than the upper limit value Vgmaxth and whether or not the minimum value Vgmin obtained in Step 1320 of FIG. 13 equals or exceeds the lower limit value Vgminth. In other words, the CPU determines whether or not the sub-FB learned value KSFBg is within a threshold width defined by the lower limit value Vgminth and the upper limit value Vgmaxth during the condition determination period (the predetermined period extending from "0" on the counter CL to the threshold CLth).

Figure 11:
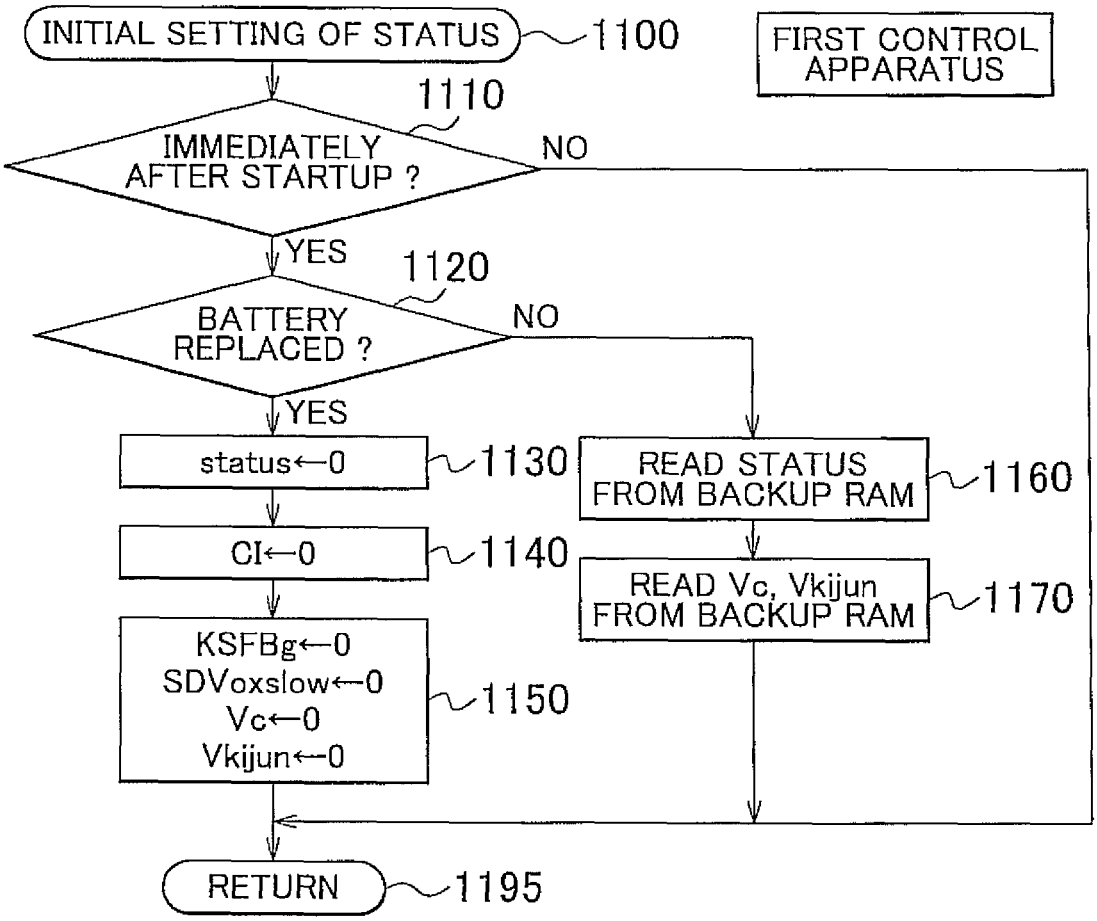
FIG. 11 is a flowchart showing a routine executed by the CPU of the first control apparatus.

According to the aforesaid assumption, the battery was replaced prior to engine startup, and therefore the sub-FB learned value KSFBg is set at "0" in Step 1150 of FIG. 11. In this case, a difference between the sub-FB learned value KSFBg and the convergence value ki×SDVoxsfinal (a difference between the time integrated value SDVoxs and the convergence value SDVoxsfinal thereof) is typically large, and therefore the variation speed of the sub-feedback amount KSFB and the sub-FB learned value KSFBg is high. Hence, either the maximum value Vgmax is greater than the upper limit value Vgmaxth or the minimum value Vgmin is smaller than the lower limit value Vgminth.

Accordingly, the CPU determines "No" in Step 1415 and advances, via Step 1495, to Step 1340 of FIG. 13, where the center value Vc is set as the determination reference value Vkijun. The center value Vc is calculated in Step 1060 of FIG. 10. Therefore, at the time of execution of the status determination in Step 1335, the CPU sets the weighted average (the center value Vc, which is a value corresponding to a first order delay) of the sub-FB learned value KSFBg from a time that is earlier than this time by the condition determination period (the period from "0" on the counter CL to the threshold CLth) to this time as the determination reference value Vkijun. The CPU then advances to Step 1395, where the routine is temporarily terminated. As a result, the status is maintained at "0".

As this condition persists, the sub-FB learned value KSFBg approaches the convergence value ki×SDVoxsfinal, and in the vicinity of the convergence value ki×SDVoxsfinal, the sub-FB learned value KSFBg varies comparatively gently. As a result, the maximum value Vgmax falls to or below the "upper limit value Vgmaxth calculated in Step 1410" and the minimum value Vgmin rises to or above the "lower limit value Vgminth calculated in Step 1410". After advancing to Step 1415 of FIG. 14 at this time, the CPU determines "Yes" in Step 1415 and then advances to Step 1420, where the status is set at "1". The CPU then advances, via Step 1495, to Step 1340 of FIG. 13.

Note that even when the condition of Step 1415 is not established, if the condition of Step 1260 in FIG. 12 (whereby the counter CI equals or exceeds the update threshold CIth) is established while the status is at "0", the status is modified to "1" in Step 1270.

When the CPU advances via Step 1335 of the routine in FIG. 13 to Step 1405 of FIG. 14 thereafter, the status is set at "1", and therefore the CPU determines "No" in Step 1405. The CPU then advances to Step 1430 and determines whether or not the status is "1". In this case, the CPU determines "Yes" in Step 1430 and advances to Step 1435, where the CPU sets a value (Vkijun+ΔV1) obtained by adding a "second value ΔV1(ΔV1>0), which is smaller than the first value ΔV0," to the determination reference value Vkijun as the upper limit value Vgmaxth. Further, the CPU sets a value (Vkijun−ΔV1) obtained by subtracting the "second value ΔV1" from the determination reference value Vkijun as the lower limit value Vgminth. Note that the second value ΔV1 will also be referred to as a specific value.

Next, the CPU advances to Step 1440, where the CPU determines whether or not the maximum value Vgmax obtained in Step 1320 of FIG. 13 is no greater than the upper limit value Vgmaxth and whether or not the minimum value Vgmin obtained in Step 1320 of FIG. 13 equals or exceeds the lower limit value Vgminth.

If the sub-FB learned value KSFBg has approached the convergence value ki×SDVoxsfinal at this time, the maximum value Vgmax is equal to or smaller than the upper limit value Vgmaxth and the minimum value Vgmin is equal to or greater than the lower limit value Vgminth. In this case, the CPU determines "Yes" in Step 1440 and advances to Step 1445, where the status is set at "2". The CPU then advances to Step 1340 of FIG. 13 via Step 1495.

When the CPU advances via Step 1335 of the routine in FIG. 13 to Step 1405 of FIG. 14 thereafter, the status is set at "2", and therefore the CPU determines "No" in Step 1405, determines "No" likewise in Step 1430, and then advances to Step 1455.

In Step 1455, the CPU sets a value (Vkijun+ΔV2) obtained by adding a "third value ΔV2 (ΔV2>0), which is smaller than the second value ΔV1," to the determination reference value Vkijun as the upper limit value Vgmaxth. Further, the CPU sets a value (Vkijun−ΔV2) obtained by subtracting the "third value ΔV2" from the determination reference value Vkijun as the lower limit value Vgminth. Note that the third value ΔV2 will also be referred to as a specific value. Further, the third value ΔV2 may take an identical value to the second value ΔV1.

Next, the CPU advances to Step 1460, where the CPU determines whether or not the maximum value Vgmax obtained in Step 1320 of FIG. 13 is no greater than the upper limit value Vgmaxth and whether or not the minimum value Vgmin obtained in Step 1320 of FIG. 13 equals or exceeds the lower limit value Vgminth.

If the sub-FB learned value KSFBg is stable in the vicinity of the convergence value ki×SDVoxsfinal at this time, the maximum value Vgmax is equal to or smaller than the upper limit value Vgmaxth and the minimum value Vgmin is equal to or greater than the lower limit value Vgminth. In this case, the CPU determines "Yes" in Step 1460 and advances to Step 1495.

If for some reason (for example, a disturbance that greatly disturbs the air-fuel ratio, such as variation in a misfire rate) the maximum value Vgmax is larger than the "upper limit value Vgmaxth, i.e. (Vkijun+ΔV2)" or the minimum value Vgmin is smaller than the "lower limit value Vgminth, i.e. (Vkijun−ΔV2)", on the other hand, the CPU determines "No" in Step 1460 and advances to Step 1465, where the status is set at "1".

Further, when the maximum value Vgmax is larger than the "upper limit value Vgmaxth, i.e. (Vkijun+ΔV1)" or the minimum value Vgmin is smaller than the "lower limit value Vgminth, i.e. (Vkijun−ΔV1)" while the status is set at "1", the CPU determines "No" in Step 1440 and advances to Step 1450, where the status is set at "0".

[Setting of Proportional Gain Kp]

Figure 15:
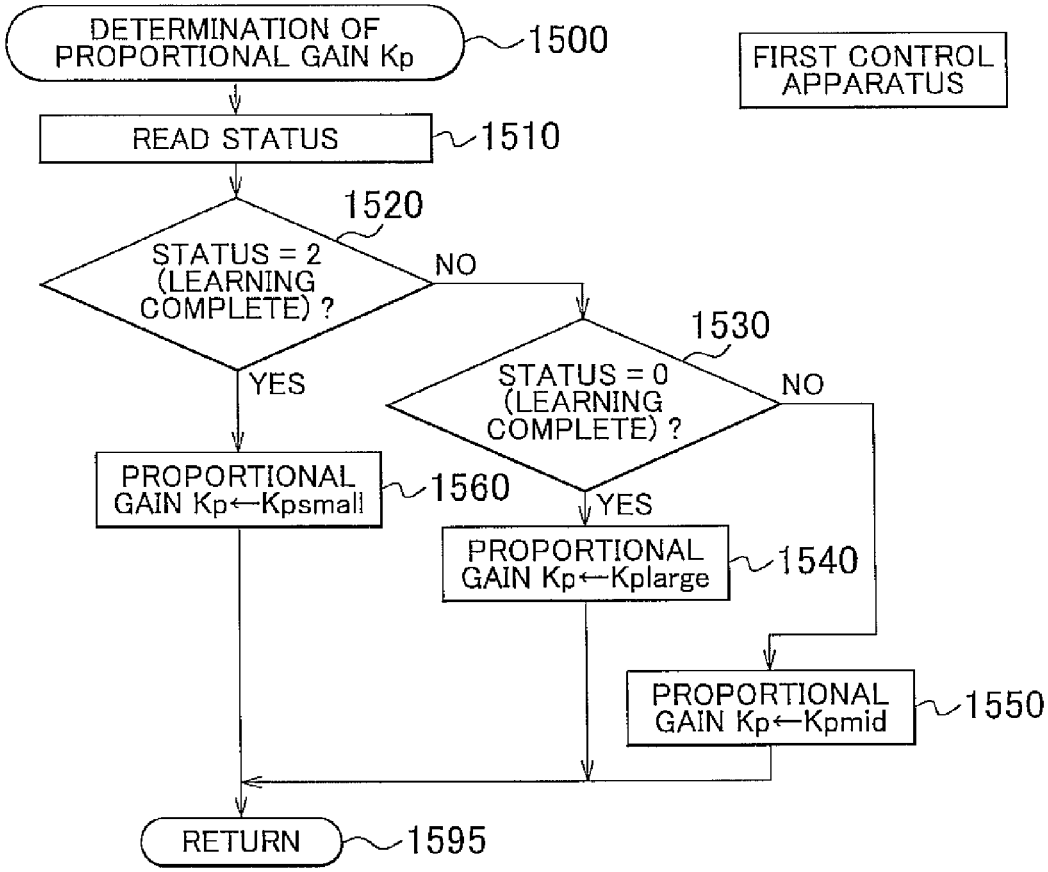
FIG. 15 is a flowchart showing a routine executed by the CPU of the first control apparatus.

To determine the proportional gain Kp, the CPU executes a routine shown in a flowchart of FIG. 15 repeatedly at predetermined time intervals. In this routine, the proportional gain Kp is set at one of a first proportional gain (a minimum proportional gain) Kpsmall, a second proportional gain (an intermediate proportional gain) Kpmid, and a third proportional gain (a maximum proportional gain) Kplarge. The third proportional gain Kplarge is larger than the second proportional gain Kpmid, and the second proportional gain Kpmid is larger than the first proportional gain Kpsmall. In other words, Kpsmall<Kpmid<Kplarge is established.

When a predetermined timing arrives, the CPU starts the processing from Step 1500 in FIG. 15, and then reads the status in Step 1510.

Next, the CPU advances to Step 1520, where the CPU determines whether or not the status is "2". In other words, the CPU determines in Step 1520 whether or not learning of the sub-FB learned value KSFBg is complete (whether or not the sub-FB learned value KSFBg is sufficiently close to the convergence value ki×SDVoxsfinal).

When the status is "2" at this time, the CPU determines "Yes" in Step 1520 and advances to Step 1560, where the proportional gain Kp is set at the first proportional gain (the minimum proportional gain) Kpsmall. The CPU then advances to Step 1595, where the routine is temporarily terminated.

When the status is not "2" at the point where the CPU performs the processing of Step 1520, on the other hand, the CPU determines "No" in Step 1520 and advances to Step 1530, where the CPU determines whether or not the status is "0". In other words, the CPU determines in Step 1530 whether or not learning of the sub-FB learned value KSFBg has made substantially no progress (whether or not the sub-FB learned value KSFBg diverges greatly from the convergence value ki×SDVoxsfinal).

When the status is "0" at this time, the CPU determines "Yes" in Step 1530 and advances to Step 1540, where the proportional gain Kp is set at the third proportional gain (the maximum proportional gain) Kplarge. The CPU then advances to Step 1595, where the routine is temporarily terminated.

When the status is not "0" at the point where the CPU performs the processing of Step 1530, on the other hand, the CPU determines "No" in Step 1530 and advances to Step 1550, where the proportional gain Kp is set at the second proportional gain Kpmid. The CPU then advances to Step 1595, where the routine is temporarily terminated.

To summarize, the CPU sets the proportional gain Kp as follows.

(1) When the status is "0": proportional gain Kp=third proportional gain Kplarge.

(2) When the status is "1": proportional gain Kp=second proportional gain Kpmid.

(3) When the status is "2": proportional gain Kp=first proportional gain Kpsmall.

[Setting of Adjustment Gain K]

Figure 16:
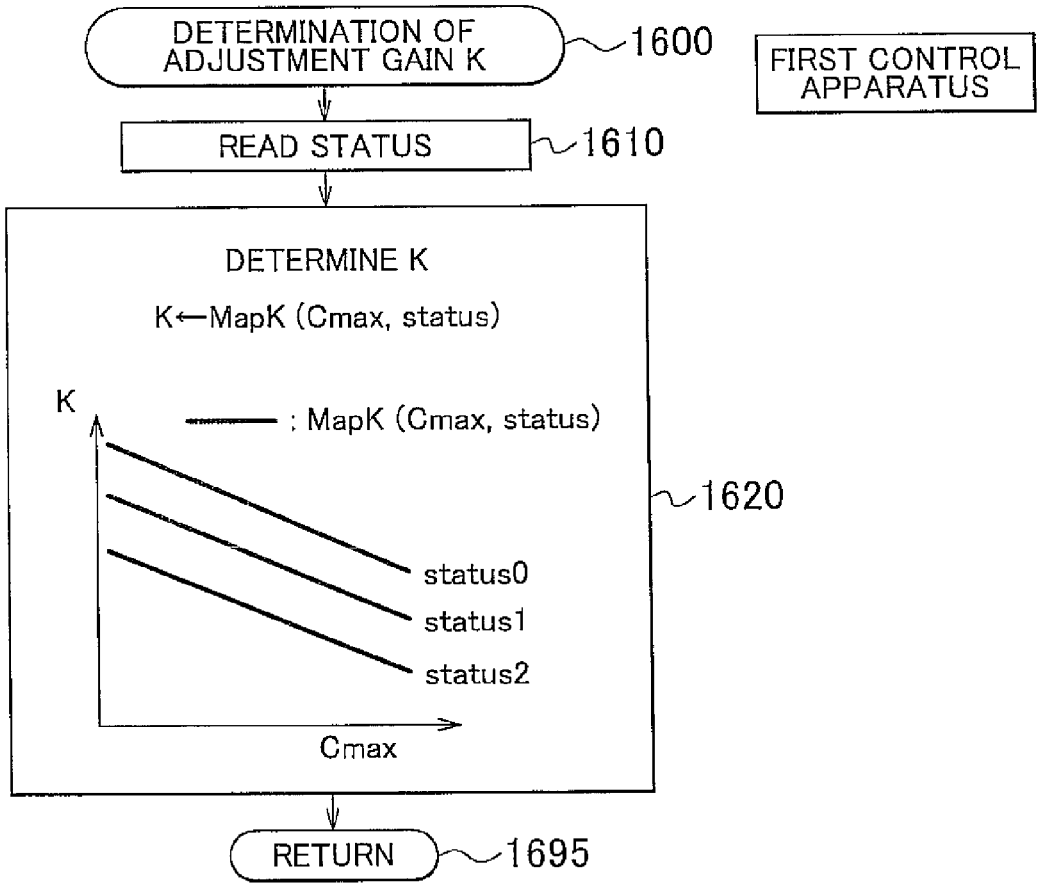
FIG. 16 is a flowchart showing a routine executed by the CPU of the first control apparatus.

To determine the adjustment gain K, the CPU executes a routine shown on a flowchart of FIG. 16 repeatedly at predetermined time intervals.

When a predetermined timing arrives, the CPU starts the processing from Step 1600 in FIG. 16, and then reads the status in Step 1610.

Next, the CPU advances to Step 1620, where the adjustment gain K is determined on the basis of a table MapK (Cmax, status) illustrated in Step 1620. The CPU then advances to Step 1695, where the routine is temporarily terminated.

According to the table MapK (Cmax, status), when the maximum oxygen storage amount Cmax is constant, the adjustment gain K is determined such that the adjustment gain K at status 0 is larger than the adjustment gain K at status 1 and the adjustment gain K at status 1 is larger than the adjustment gain K at status 2.

Also according to the table MapK (Cmax, status), when the status value is constant, the adjustment gain K is determined to have a "smaller value" as the maximum oxygen storage amount Cmax increases.

Note that the maximum oxygen storage amount Cmax of the upstream side catalyst 43 is a maximum value of the amount of oxygen that can be stored in the upstream side catalyst 43, which is obtained separately through so-called active air-fuel ratio control. The maximum oxygen storage amount Cmax decreases as deterioration of the upstream side catalyst 43 advances. Active air-fuel ratio control is described in Japanese Patent Application Publication No. 5-133264 (JP-A-5-133264) and so on, for example, and therefore detailed description of this control has been omitted. The maximum oxygen storage amount Cmax is stored/updated in the backup RAM every time it is obtained.

As described above, the first control apparatus includes a correction amount calculation unit which, in a period during which a predetermined downstream side feedback condition (the sub-feedback control condition) is established, calculates the proportional term (=kp×DVoxslow) by multiplying the predetermined proportional gain Kp by the output deviation (DVoxslow), which is a value that correlates with the deviation between the output value Voxs of the downstream side air-fuel ratio sensor 57 and the predetermined downstream side target value Voxsref, calculates the time integrated value (SDVoxslow) by integrating a value (K×DVoxslow) obtained by multiplying the predetermined adjustment gain K by the output deviation (DVoxslow), calculates a value (Ki×SDVoxslow) that is commensurate with the calculated time integrated value (SDVoxslow) as the integral term, and calculates the sub-feedback amount KSFB (in other words, a correction amount for aligning the output value Voxs of the downstream side air-fuel ratio sensor 57 with the downstream side target value Voxsref and an air-fuel ratio feedback amount for feedback-correcting the amount of fuel injected from the fuel injection valve 33) on the basis of at least the "proportional term (=kp×DVoxslow) and the integral term (=Ki×SDVoxslow)" (see Steps 1005 to 1040 of FIG. 10).

Further, the first control apparatus includes a learning unit that obtains a value (Ki×SDVoxslow) that correlates with the calculated integral term (=Ki×SDVoxslow) as the learned value (the sub-FB learned value KSFBg) (see Steps 1045 and 1055 of FIG. 10), and a fuel injection control unit that calculates the final fuel injection amount Fi (k) on the basis of at least the air-fuel ratio feedback amount (the sub-feedback amount KSFB) when the downstream side feedback condition is established (see Steps 720 to 760 in the routine of FIG. 7 and the routine of FIG. 8), calculates the final fuel injection amount Fi (k) on the basis of at least the learned value (the sub-FB learned value KSFBg) when the downstream side feedback condition is not established (see Steps 720 to 760 in the routine of FIG. 7, the routine of FIG. 8, and Step 1070 of FIG. 10), and causes the fuel injection valve 33 to inject fuel in the calculated final fuel injection amount Fi (k) (step 770 of FIG. 7).

Moreover, the learning unit of the first control apparatus is configured to determine that the learned value (the sub-FB learned value KSFBg) has converged when the learned value exists between the predetermined upper limit value Vgmaxth and the predetermined lower limit value Vgminth for the predetermined time (see in particular Steps 1320 and 1335 of FIG. 13 and the routine of FIG. 14).

Furthermore, the correction amount calculation unit of the first control apparatus is configured to set the proportional gain Kp at a smaller value after the learned value (the sub-FB learned value KSFBg) is determined to have converged (after the status has been set at "2", for example) than before the learned value is determined to have converged (when the status is set at "1", for example) (see the routine of FIG. 15), and to set the adjustment gain K at a smaller value after the learned value (the sub-FB learned value KSFBg) is determined to have converged (after the status has been set at "2", for example) than before the learned value is determined to have converged (when the status is set at "1", for example) (see Step 1620 of FIG. 16).

As a result, the variation amount of the sub-FB learned value KSFBg within the predetermined period (the condition determination period from 0 on the counter CL to the threshold CLth) is small before the sub-FB learned value KSFBg is determined to have converged (before the status is determined to be at "2", for example), and therefore the determination that the sub-FB learned value KSFBg has converged can be made earlier. Moreover, the frequency with which the oxygen storage amount OSA of the catalyst 43 reaches the "maximum oxygen storage amount Cmax" and "0" decreases (the aforesaid inversion period of the output value Voxs lengthens) after the sub-FB learned value KSFBg is determined to have converged (after the status is determined to be at "2", for example), and therefore emissions can be reduced.

Furthermore, with the first control apparatus, the adjustment gain K decreases as convergence of the sub-FB learned value KSFBg advances. Therefore, before the sub-FB learned value KSFBg is determined to have converged (when the status is "0" or "1"), the sub-FB learned value KSFBg can be brought closer to an appropriate value (an intended convergence value) quickly, and after the sub-FB learned value KSFBg is determined to have converged (after the status has been set at "2"), the sub-FB learned value KSFBg can be maintained in the vicinity of the appropriate value with stability.

Second Embodiment

Next, a control apparatus (also referred to as a "second control apparatus" hereafter) according to a second embodiment of the invention will be described. The second control apparatus differs from the first control apparatus only in that before the sub-FB learned value KSFBg is determined to have converged (when the status is "0" or "1", for example), the proportional gain Kp is set at a "value that decreases as the intake air amount Ga increases (in actuality, a value in inverse proportion to the intake air amount Ga)". The following description will focus on this difference.

Figure 17:
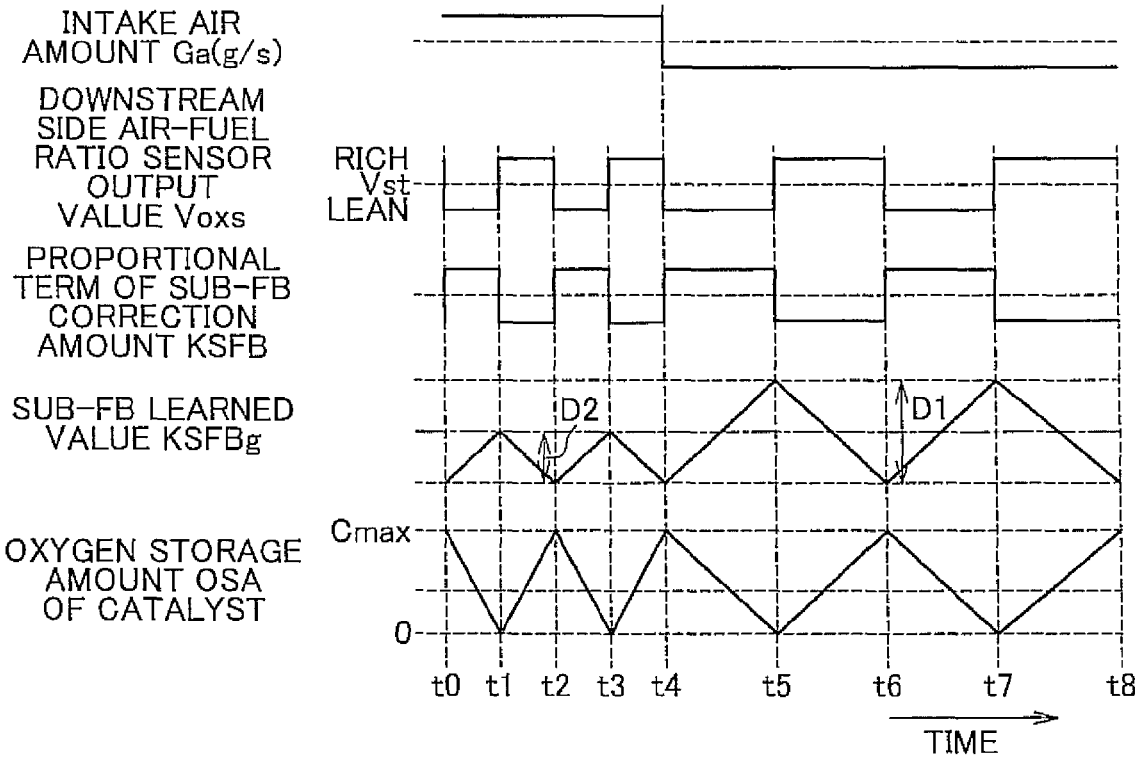
FIG. 17 is a time chart showing variation in the output value of the downstream side air-fuel ratio sensor, a proportional term of a sub-feedback amount, the sub-FB learned value, and so on when variation occurs in an intake air amount.

Even when the air-fuel ratio flowing into the catalyst 43 takes "a certain value", the amount of "excessive oxygen or excessive unburned material" flowing into the catalyst 43 increases as the intake air amount Ga increases. Accordingly, the variation speed of the oxygen storage amount of the catalyst 43 increases as the intake air amount Ga increases. Therefore, as shown in FIG. 17, in a case where the proportional gain Kp is maintained at a constant value regardless of the intake air amount Ga, the "inversion period of the output value Voxs of the downstream side air-fuel ratio sensor 57" when the intake air amount is small (from a time t4 onward) is longer than the "inversion period of the output value Voxs of the downstream side air-fuel ratio sensor 57" when the intake air amount Ga is large (from a time t1 to the time t4). As a result, the variation amount of the learned value (the sub-FB learned value) increases (see variation amounts D1 and D2) as the intake air amount Ga decreases.

However, the second control apparatus sets the proportional gain Kp at a "value that decreases as the intake air amount Ga increases (in actuality, a value in inverse proportion to the intake air amount Ga)" before the sub-FB learned value KSFBg is determined to have converged (when the status is "0" or "1", for example).

Figure 18:
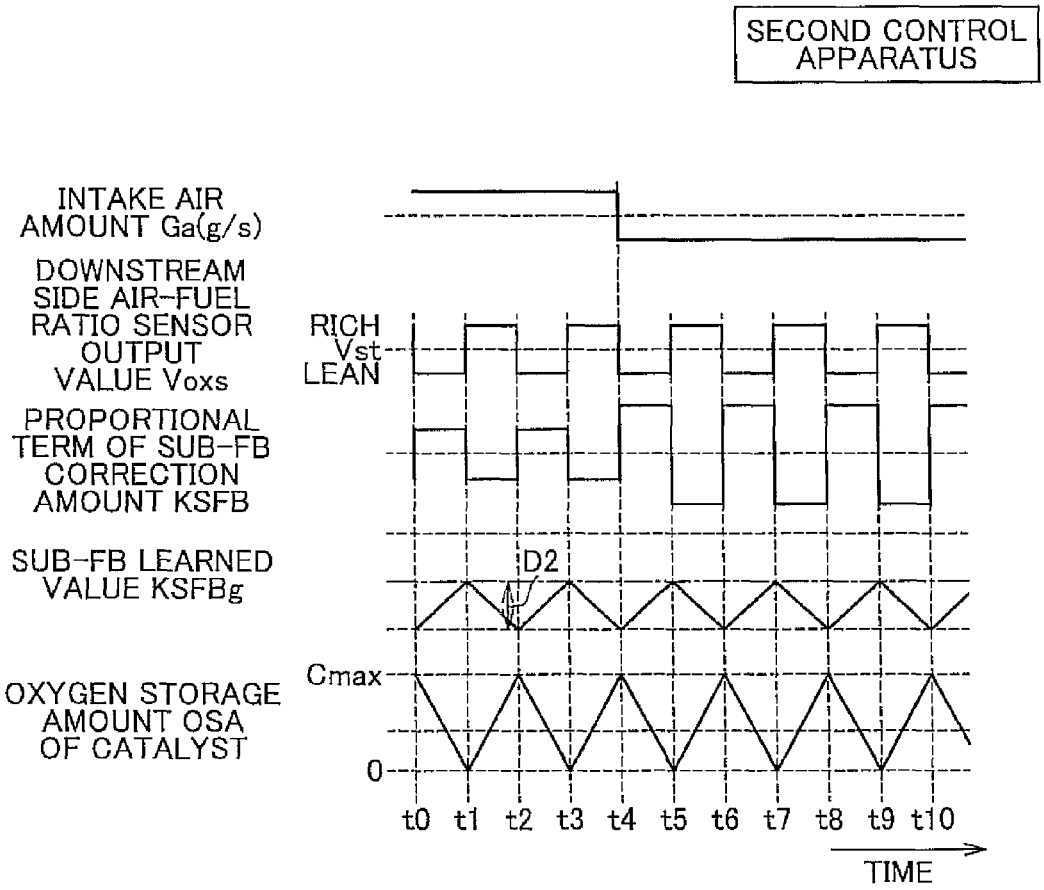
FIG. 18 is a time chart showing variation in the output value of the downstream side air-fuel ratio sensor, the proportional term of the sub-feedback amount, the sub-FB learned value, and so on when variation occurs in the intake air amount in a fuel injection amount control apparatus (a second control apparatus) according to a second embodiment of the invention.

As a result, as shown in FIG. 18, the "inversion period of the output value Voxs of the downstream side air-fuel ratio sensor 57" can be kept substantially constant even when the intake air amount Ga varies (see before and after a time t4). Hence, the variation amount of the sub-FB learned value KSFBg during the condition determination period does not increase even when the intake air amount Ga decreases, and therefore the second control apparatus can "determine that the sub-FB learned value KSFBg has converged (determine that the status is at "2")" early.

(Actual Operation)

Next, an actual operation of the second control apparatus will be described. A CPU of the second control apparatus executes the routines of the FIGS. 7 to 14, a routine shown in FIG. 19 in place of the routine shown in FIG. 15, and the routine shown in FIG. 16. The routines shown in the drawings other than FIG. 19 were described above, and therefore the routine shown in FIG. 19 will now be described. Note that of the steps shown in FIG. 19, steps in which identical processing to that of the steps of FIG. 15 is performed have been allocated identical reference numerals to the corresponding steps. Further, values "Kplarge, Kpmid, and Kpsmall" to be described below are respectively identical to the values "Kplarge, Kpmid, and Kpsmall" used by the first control apparatus.

Figure 19:
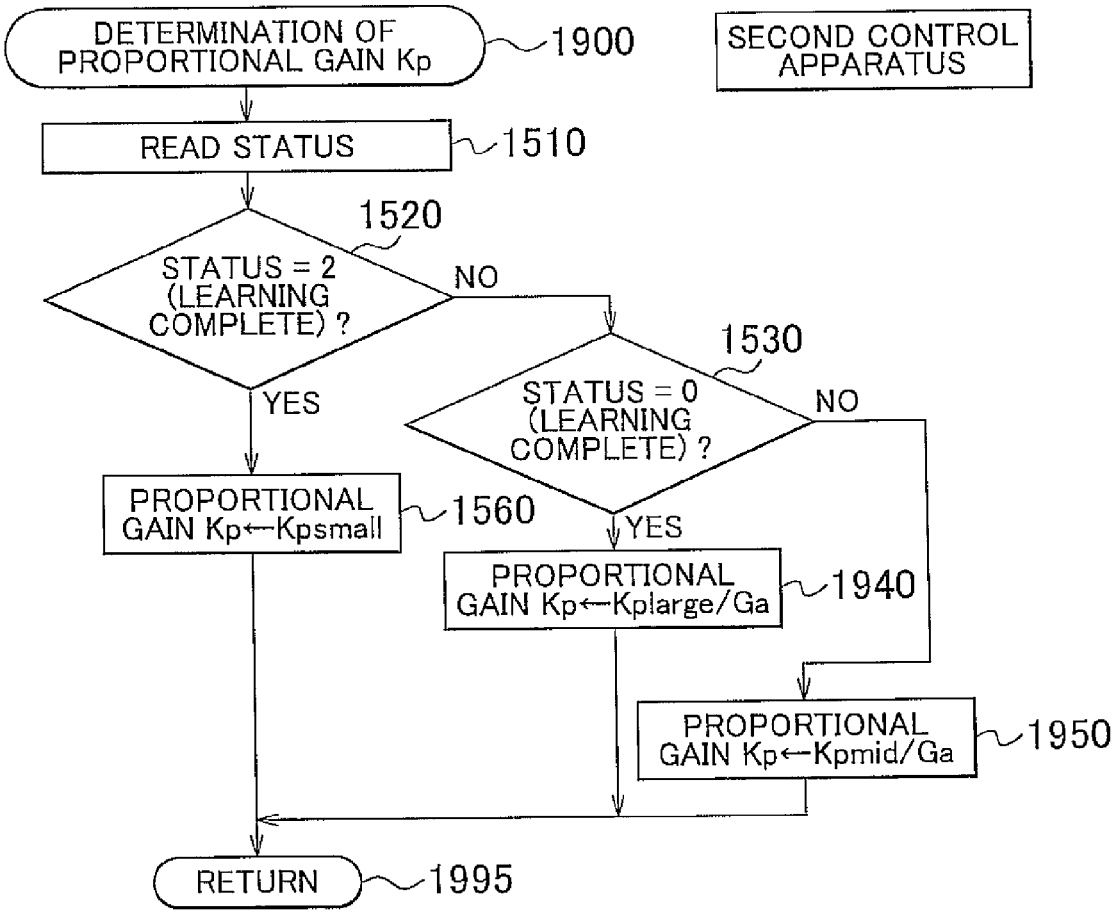
FIG. 19 is a flowchart showing a routine executed by a CPU of the second control apparatus.

In the routine of FIG. 19, Steps 1540 and 1550 of FIG. 15 are replaced by Step 1940 and Step 1950, respectively. Accordingly, when learning of the sub-FB learned value KSFBg has made substantially no progress, or in other words when the status is "0", the CPU of the second control apparatus advances from Step 1530 to Step 1940, where the proportional gain Kp is set at a "third proportional gain (maximum proportional gain) Kplarge/Ga that is inversely proportionate to the intake air amount Ga". The CPU then advances to Step 1995, where the routine is temporarily terminated. As a result, when the status is "0", the proportional gain Kp is set at a smaller value Kplarge/Ga as the intake air amount Ga increases. Note that the value Kplarge/Ga is equal to or larger than the first proportional gain (minimum proportional gain) Kpsmall.

Further, when the convergence condition of the sub-FB learned value KSFBg corresponds to a semi-stable condition, or in other words when the status is "1", the CPU of the second control apparatus advances from Step 1530 to Step 1950, where the proportional gain Kp is set at a "second proportional gain (intermediate proportional gain) Kpmid/Ga that is inversely proportionate to the intake air amount Ga". The CPU then advances to Step 1995, where the routine is temporarily terminated. As a result, when the status is "1", the proportional gain Kp is set at a smaller value Kpmid/Ga as the intake air amount Ga increases. Note that the value Kpmid/Ga is equal to or larger than the first proportional gain (minimum proportional gain) Kpsmall. Further, when the intake air amount Ga is "a certain specific value", the value Kpmid/Ga is smaller than the value Kplarge/Ga.

To summarize, the CPU sets the proportional gain Kp as follows. (1) When the status is "0": proportional gain Kp=Kplarge/Ga. (2) When the status is "1": proportional gain Kp=Kpmid/Ga. (3) When the status is "2": proportional gain Kp=Kpsmall.

As described above, the second control apparatus includes a similar correction amount calculation unit to the first control apparatus. Note, however, that the correction amount calculation unit of the second control apparatus is configured to increase the proportional gain Kp as the intake air amount Ga decreases before the learned value (the sub-FB learned value KSFBg) is determined to have converged (when the status is "1", for example) (see Step 1950 of FIG. 19).

As a result, the "inversion period of the output value Voxs of the downstream side air-fuel ratio sensor 57" can be kept substantially constant even when the intake air amount Ga varies. Hence, the variation amount of the sub-FB learned value KSFBg during the condition determination period does not increase even when the intake air amount Ga decreases, and therefore the second control apparatus can "determine that the sub-FB learned value KSFBg has converged (determine that the status is at "2")" early.

Note that the CPU of the second control apparatus may set the proportional gain Kp at a "value Kpsmall/Ga" in Step 1560. In other words, the second control apparatus may set the proportional gain Kp at a "value that decreases as the intake air amount Ga increases" regardless of the degree of convergence of the sub-FB learned value KSFBg.

Third Embodiment

Next, a control apparatus (also referred to as a "third control apparatus" hereafter) according to a third embodiment of the invention will be described. The third control apparatus differs from the first control apparatus only in that before the sub-FB learned value KSFBg is determined to have converged (when the status is "0" or "1", for example), the proportional gain Kp is set at a "value that decreases as the intake air amount Ga increases and decreases as the maximum oxygen storage amount Cmax of the catalyst 43 decreases". The following description will focus on this difference.

When the air-fuel ratio flowing into the catalyst 43 takes "a certain value" and the intake air amount Ga takes "a certain value", the "inversion period of the output value Voxs of the downstream side air-fuel ratio sensor 57" shortens as deterioration of the catalyst 43 advances. The reason for this is that as deterioration of the catalyst 43 advances, the maximum oxygen storage amount Cmax of the catalyst 43 decreases, and therefore the oxygen storage amount reaches "0" or the maximum oxygen storage amount Cmax early.

However, the third control apparatus sets the proportional gain Kp at a "value that decreases as the maximum oxygen storage amount Cmax decreases" before the sub-FB learned value KSFBg is determined to have converged (when the status is "0" or "1", for example).

As a result, the "inversion period of the output value Voxs of the downstream side air-fuel ratio sensor 57" can be kept substantially constant regardless of the extent to which deterioration of the catalyst 43 has advanced (a degree of deterioration). Hence, the variation amount of the sub-FB learned value KSFBg can be kept substantially constant once the sub-FB learned value KSFBg has substantially converged, regardless of the extent to which the catalyst 43 has deteriorated, and as a result, the third control apparatus can "determine that the sub-FB learned value KSFBg has converged (determine that the status is at "2")" early.

(Actual Operation)

Next, an actual operation of the third control apparatus will be described. A CPU of the third control apparatus executes the routines of the FIGS. 7 to 14, a routine shown in FIG. 20 in place of the routine shown in FIG. 15, and the routine shown in FIG. 16. The routines shown in the drawings other than FIG. 20 were described above, and therefore the routine shown in FIG. 20 will now be described.

Figure 20:
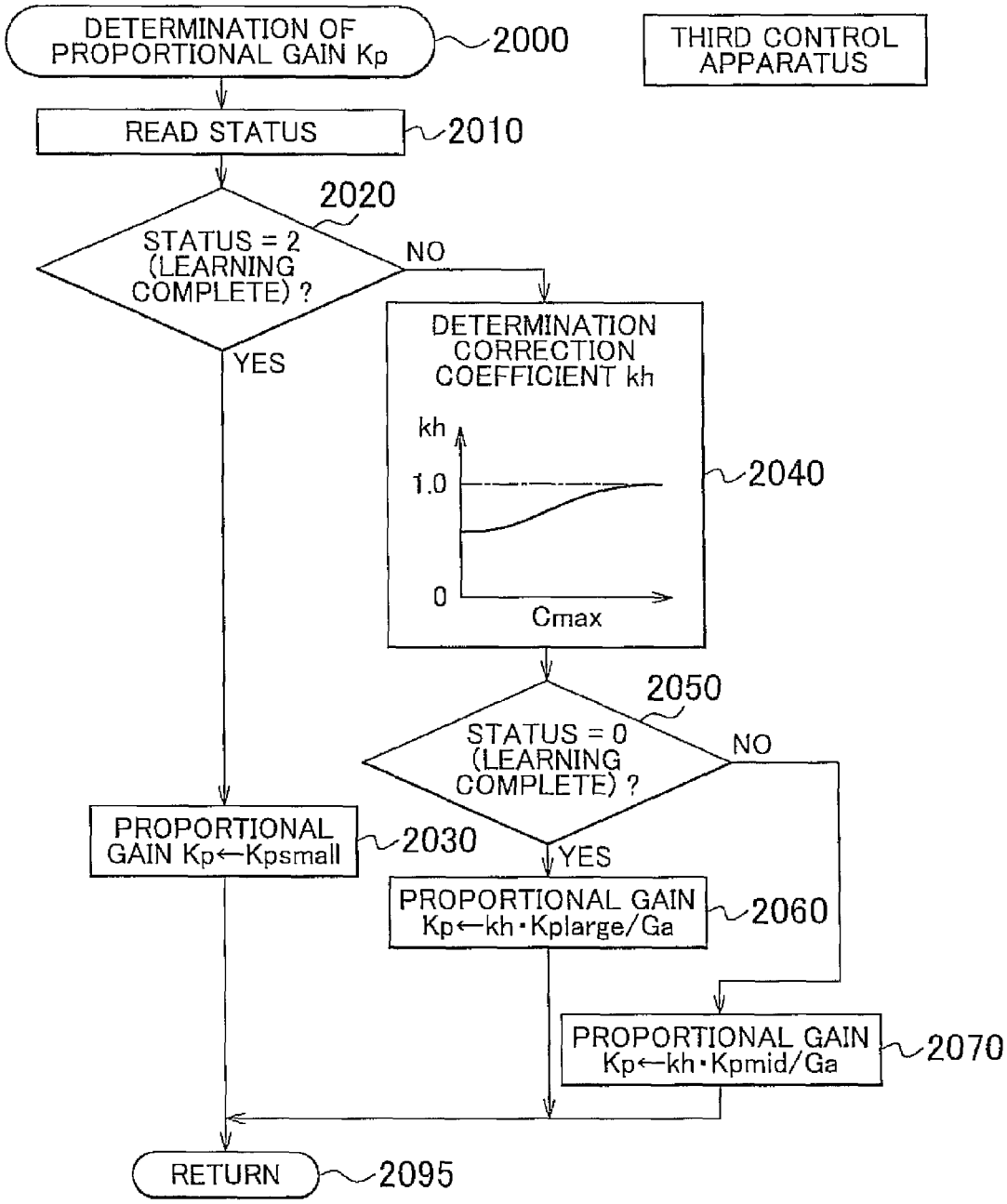
FIG. 20 is a flowchart showing a routine executed by a CPU of a fuel injection amount control apparatus (a third control apparatus) according to a third embodiment of the invention.

To determine the proportional gain Kp, the CPU of the third control apparatus executes the routine shown on the flowchart in FIG. 20 repeatedly at predetermined time intervals. Accordingly, when a predetermined timing arrives, the CPU starts the processing from Step 2000 in FIG. 20, and reads the status in Step 2010.

Next, the CPU advances to Step 2020, where the CPU determines whether or not the status is "2". In other words, the CPU determines in Step 2020 whether or not learning of the sub-FB learned value KSFBg is complete (whether or not the sub-FB learned value KSFBg is sufficiently close to the convergence value ki×SDVoxsfinal.

When the status is "2" at this time, the CPU determines "Yes" in Step 2020 and advances to Step 2030, where the proportional gain Kp is set at the first proportional gain (minimum proportional gain) Kpsmall used by the first control apparatus. The CPU then advances to Step 2095, where the routine is temporarily terminated.

When the status is not "2" at the point where the CPU performs the processing of Step 2020, on the other hand, the CPU determines "No" in Step 2020 and advances to Step 2040, where a correction coefficient (a catalyst deterioration correction coefficient) kh is determined. The correction coefficient kh is determined to decrease within a range smaller than "1" as the maximum oxygen storage amount Cmax decreases. Note that the correction coefficient kh takes a positive value.

Next, the CPU advances to Step 2050, where the CPU determines whether or not the status is "0". In other words, the CPU determines in Step 2050 whether or not learning of the sub-FB learned value KSFBg has made substantially no progress (whether or not the sub-FB learned value KSFBg diverges greatly from the convergence value ki× SDVoxsfinal).

When the status is "0" at this time, the CPU determines "Yes" in Step 2050 and advances to Step 2060, where the proportional gain Kp is set at a third proportional gain (a maximum proportional gain). The third proportional gain is a value (=kh×Kplarge/Ga) obtained by dividing a product of the correction coefficient kh and the maximum proportional gain Kplarge used by the first control apparatus by the intake air amount Ga. The CPU then advances to Step 2095, where the routine is temporarily terminated.

Hence, when the status is "0", the proportional gain kp is set at the value kh×Kplarge/Ga, which decreases as the intake air amount Ga increases and decreases as the maximum oxygen storage amount Cmax decreases. Note, however, that the value kh×Kplarge/Ga no smaller than the first proportional gain (the minimum proportional gain) Kpsmall.

Further, when the status is not "0" at the point where the CPU performs the processing of Step 2050, the CPU determines "No" in Step 2050 and advances to Step 2070, where the proportional gain Kp is set at a second proportional gain (an intermediate proportional gain). The second proportional gain is a value (=kh×Kpmid/Ga) obtained by dividing a product of the correction coefficient kh and the intermediate proportional gain Kpmid used by the first control apparatus by the intake air amount Ga. The CPU then advances to Step 2095, where the routine is temporarily terminated.

Hence, when the status is "1", the proportional gain kp is set at the value kh×Kpmid/Ga, which decreases as the intake air amount Ga increases and decreases as the maximum oxygen storage amount Cmax decreases. Note, however, that the value kh×Kpmid/Ga no smaller than the first proportional gain (the minimum proportional gain) Kpsmall.

To summarize, the CPU sets the proportional gain Kp as follows. (1) When the status is "0": proportional gain Kp=kh×Kplarge/Ga. (2) When the status is "1": proportional gain Kp=kh×Kpmid/Ga. (3) When the status is "2": proportional gain Kp=Kpsmall.

As described above, the third control apparatus includes a similar correction amount calculation unit to the first control apparatus. However, the correction amount calculation unit of the third control apparatus is configured to reduce the proportional gain Kp as the intake air amount Ga increases and reduce the proportional gain Kp as the degree of deterioration of the catalyst 43 advances (increases) before the learned value (the sub-FB learned value KSFBg) is determined to have converged (when the status is "1", for example) (see Step 2040 of FIG. 20 and the other steps of FIG. 20).

As a result, the third control apparatus can keep the "inversion period of the output value Voxs of the downstream side air-fuel ratio sensor 57" substantially constant regardless of the degree of deterioration of the catalyst 43 and the magnitude of the intake air amount Ga. Hence, the variation amount of the learned value (the sub-FB learned value KSFBg) can be kept substantially constant once the learned value has substantially converged, regardless of the degree of deterioration of the catalyst 43, and therefore the third control apparatus can "determine that the sub-FB learned value KSFBg has converged" early.

Note that in Step 2030, the CPU of the third control apparatus may set the proportional gain Kp at "the value kh×Kpsmall or the value kh×Kpsmall/Ga".

As described above, the fuel injection amount control apparatus according to the respective embodiments of the invention sets the proportional gain Kp of the sub-feedback amount KSFB at a smaller value after the sub-FB learned value KSFBg is determined to have converged than before the sub-FB learned value KSFBg is determined to have converged. As a result, the sub-FB learned value KSFBg can be determined to have converged more quickly, and emissions can be reduced after the sub-FB learned value KSFBg is determined to have converged.

Note that the invention is not limited to the embodiments described above, and various modified examples may be employed within the scope of the invention. For example, during the sub-feedback control, the output value Vabyfs of the upstream side air-fuel ratio sensor 56 may be corrected using the sub-feedback amount. Furthermore, in the above embodiments, the time integrated value SDVoxslow is determined by integrating a value obtained by multiplying the predetermined adjustment gain K by the value DVoxslow, which is obtained by implementing low pass filter processing on the output deviation DVoxs, but the time integrated value SDVoxslow may be determined by integrating a value obtained by multiplying the predetermined adjustment gain K by the value DVoxs not subjected to low pass filter processing.

Further, the sub-FB learned value KSFBg may be obtained by extracting the time integrated value SDVoxslow itself or a value obtained by implementing low pass filter processing on the sub-feedback amount KSFB. In other words, the sub-FB learned value KSFBg may be any value corresponding to the steady state component of the sub-feedback amount KSFB (any value that correlates with the integral term of the sub-feedback amount KSFB).

Moreover, the fuel injection amount control apparatus according to the respective embodiments described above may be configured to determine the variation amount of the sub-FB learned value KSFBg (the learned value) within a predetermined time period, determine that the sub-FB learned value KSFBg has converged (determine that the status is "2", for example) when the variation amount is smaller than a predetermined determination threshold width, and determine that the sub-FB learned value KSFBg has not converged (determine that the status is "1" or "0", for example) when the variation amount equals or exceeds the predetermined determination threshold width.

Furthermore, the sub-feedback amount KSFB may be calculated not to include the sub-FB learned value KSFBg. In other words, setting may be performed such that KSFB=Kp×DVoxslow+Ki×SDVoxslow+Kd×DDVoxslow.

Moreover, in the second and third control apparatuses, the proportional gain Kp, which is set before the sub-FB learned value KSFBg is determined to have converged, may not be a value that is inversely proportionate to the intake air amount Ga or a value that decreases as the intake air amount Ga increases.

What is claimed is:

1. A fuel injection amount control apparatus for an internal combustion engine, comprising:

a fuel injection valve that injects a fuel into the internal combustion engine;

a downstream side air-fuel ratio sensor that is disposed downstream of a catalyst disposed in an exhaust passage of the engine and outputs an output value corresponding to an air-fuel ratio of a gas flowing out of the catalyst;

an electronic control unit configured to:

calculate, during a period in which a predetermined downstream side feedback condition is established, a proportional term by multiplying a predetermined proportional gain and an output deviation, which is a deviation between the output value of the downstream side air-fuel ratio sensor and a predetermined downstream side target value;

calculate a time integrated value by integrating a value obtained by multiplying a predetermined adjustment gain and the output deviation;

calculate a value that is commensurate with the calculated time integrated value as an integral term;

calculate an air-fuel ratio feedback amount for feedback-correcting an amount of the fuel to be injected from the fuel injection value on the basis of at least the proportional term and the integral term, the air fuel ratio feedback amount being a correction amount for aligning the output value of the downstream side air-fuel ratio sensor with the downstream side target value;

obtain a value that correlates with the calculated integral term as a learned value;

calculate a final fuel injection amount on the basis of at least the air-fuel ratio feedback amount when the downstream side feedback condition is established; and calculate the final fuel injection amount on the basis of at least the learned value when the downstream side feedback condition is not established;

determine that the learned value has converged when the learned value exists between a predetermined upper limit value and a predetermined lower limit value for a predetermined time, or when a variation amount of the learned value over the predetermined time is smaller than a determination threshold width;

set the predetermined proportional gain at a smaller value after the learned value is determined to have converged than before the learned value is determined to have converged;

set the predetermined adjustment gain at a smaller value after the learned value is determined to have converged than before the learned value is determined to have converged; and increase the predetermined proportional gain as an intake air amount of the engine decreases before the learned value is determined to have converged, wherein the fuel injection valve injects the calculated final fuel injection amount on the basis of at least the air-fuel ratio feedback amount when the downstream side feedback condition is established and the fuel injection valve injects the final fuel injection amount on the basis of at least the learned value when the downstream side feedback condition is not established.

2. The fuel injection amount control apparatus according to claim 1, wherein the electronic control unit is configured to obtains a catalyst deterioration index value indicating a degree of deterioration of the catalyst, and determines the proportional gain on the basis of the catalyst deterioration index value such that the proportional gain decreases as the degree of deterioration of the catalyst advances.

3. A fuel injection control apparatus for an internal combustion engine, comprising:

a fuel injection valve that injects a fuel into the internal combustion engine;

a downstream side air-fuel ratio sensor that is disposed downstream of a catalyst disposed in an exhaust passage of the engine and outputs an output value corresponding to an air-fuel ratio of a gas flowing out of the catalyst;

an electronic control unit configured to:

calculate, during a period in which a predetermined downstream side feedback condition is established, a proportional term by multiplying a predetermined proportional gain and an output deviation, which is a deviation between the output value of the downstream side air-fuel ratio sensor and a predetermined downstream side target value;

calculate a time integrated value by integrating a value obtained by multiplying a predetermined adjustment gain and the output deviation;

calculate a value that is commensurate with the calculated time integrated value as an integral term;

calculate an air-fuel ratio feedback amount for feedback-correcting an amount of the fuel to be injected from the fuel injection value on the basis of at least the proportional term and the integral term, the air fuel ratio feedback amount being a correction amount for aligning the output value of the downstream side air-fuel ratio sensor with the downstream side target value;

obtain a value that correlates with the calculated integral term as a learned value;

calculate a final fuel injection amount on the basis of at least the air-fuel ratio feedback amount when the downstream side feedback condition is established;

calculate the final fuel injection amount on the basis of at least the learned value when the downstream side feedback condition is not established;

determine that the learned value has converged when the learned value exists between a predetermined upper limit value and a predetermined lower limit value for a predetermined time, or when a variation amount of the learned value over the predetermined time is smaller than a determination threshold width; and increase the proportional gain as an intake air amount of the engine decreases before the learned value is determined to have converged, wherein the fuel injection valve injects the calculated final fuel injection amount on the basis of at least the air-fuel ratio feedback amount when the downstream side feedback condition is established and the fuel injection valve injects the final fuel injection amount on the basis of at least the learned value when the downstream side feedback condition is not established.

* * * * *